US006076752A

United States Patent [19]

Paradowski et al.

[11] Patent Number: 6,076,752

[45] Date of Patent: Jun. 20, 2000

[54] METHOD AND APPARATUS FOR INERT GAS PURGING/TEMPERATURE CONTROL FOR PULVERIZING/GRINDING SYSTEM

[75] Inventors: Mark Paradowski, Piscataway; Ralph John Altreche, So. Plainfield; Carlos Mendez, Edison, all of N.J.

[73] Assignee: Quality Botanical Ingredients, Inc., South Plainfield, N.J.

[21] Appl. No.: 09/088,271

[22] Filed: Jun. 1, 1998

[51] Int. Cl.[7] ..... B02C 25/00

[52] U.S. Cl. ..... 241/16; 241/31; 241/33; 241/48; 241/DIG. 37

[58] Field of Search ..... 241/31, 57, 16, 241/33, 48, 80, DIG. 37, 79.1

[56] References Cited

U.S. PATENT DOCUMENTS

| | | | |
|---|---|---|---|
| 3,610,594 | 10/1971 | Williams | 263/15 |
| 3,734,412 | 5/1973 | Haas et al. | 241/15 |
| 3,771,729 | 11/1973 | Frable | 241/65 |
| 3,785,577 | 1/1974 | Carlsmith et al. | 241/57 |
| 3,921,917 | 11/1975 | Meinass | 241/17 |
| 4,102,503 | 7/1978 | Meinass | 241/18 |
| 4,273,294 | 6/1981 | Hollely et al. | 241/18 |
| 4,304,360 | 12/1981 | Luhr et al. | 241/5 |
| 4,428,535 | 1/1984 | Venetucci | 241/35 |
| 4,687,672 | 8/1987 | Vitkovski | 426/524 |
| 4,776,173 | 10/1988 | Kamarei et al. | 62/63 |
| 4,778,113 | 10/1988 | Jewett et al. | 241/31 |
| 4,846,410 | 7/1989 | Jewett et al. | 241/31 |
| 5,011,087 | 4/1991 | Richardson et al. | 241/5 |
| 5,022,328 | 6/1991 | Robertson | 110/232 |
| 5,137,218 | 8/1992 | Sutherland et al. | 241/31 |
| 5,203,511 | 4/1993 | Ondush et al. | 241/5 |
| 5,233,932 | 8/1993 | Robertson | 110/232 |
| 5,597,123 | 1/1997 | Steigman et al. | 241/23 |

FOREIGN PATENT DOCUMENTS

| | | |
|---|---|---|
| 2952363 | 7/1981 | Germany . |
| 2073048 | 10/1981 | United Kingdom . |

*Primary Examiner*—Joseph J. Hail, III
*Assistant Examiner*—Dermott J. Cooke
*Attorney, Agent, or Firm*—Watov & Kipnes, P.C

[57] ABSTRACT

In a grinding/pulverizing system the combustion of the material being processed is avoided by grinding or pulverizing the material at temperatures below the combustion temperature of the material, and/or in an atmosphere of reduced oxygen level incapable of supporting combustion of the material at the processing temperature.

19 Claims, 19 Drawing Sheets

MANUAL OPERATION SPECIFIC TO PAGE 2 OF 6
TYPICAL OF ALL ANALOG CONTROL LOOPS

METHOD AND APPARATUS FOR INERT GAS PURGING/TEMPERATURE CONTROL FOR PULVERIZING/GRINDING SYSTEM

FIELD OF THE INVENTION

The present invention relates generally to grinding systems, and more particularly to systems for grinding flammable materials, such as organic materials in a manner to prevent combustion of the material during the grinding process.

BACKGROUND OF THE INVENTION

In grinding and/or pulverizing various materials, care must be taken during processing of flammable materials to avoid combustion of these materials. This is particularly true in the grinding or organic materials, such as herbal products, which may require the grinding and/or pulverizing of root and leaf material of various herbal plants, such as ginseng, for example. If during the grinding and/or pulverizing of particular herbal products for later human consumption, if the herbal material is subjected to temperatures that exceed the temperature of combustion, even if only a portion of the material goes into combustion or burns, the entire batch of the material being processed may be so contaminated that it will be unuseable for human consumption. Also, if such herbal material, other organic material, and yet other combustible material, inadvertently goes into combustion or burns during a grinding and/or pulverizing processing, because of dust that normally may be generated, there is an additional hazard of explosion, as well as the inherent dangers of the fire spreading from the equipment, thereby creating an extremely dangerous condition. Accordingly, care must be taken to avoid combustion of flammable materials during the grinding and/or pulverizing of such materials.

SUMMARY OF THE INVENTION

It is an object of the present invention to provide an improved grinding and/or pulverizing system for the processing of flammable materials, including but not limited to organic materials such as herbal products.

Another object of the invention is to provide an improved grinding and/or pulverizing system for flammable materials that provides for the processing to be carried out in an atmosphere of reduced oxygen incapable of supporting combustion of the material.

Another object of the invention is to provide a grinding and/or pulverizing system in which the temperature of the material being processed is safely maintained below its temperature of combustion during processing.

Yet another object of the invention is to provide a grinding and/or pulverizing system for substantially preventing combustion of the material being processed by maintaining the level of oxygen in the atmosphere of the grinder/pulverizer below that capable of supporting combustion of the material, while at the same time maintaining the temperature of the material during processing below the temperature of combustion of the material.

With the problems of the prior art in mind, the previous mentioned objects and other objects of the invention are provided by enclosing the main portions of a grinder/processing station to substantially seal off the latter from the ambient air. A closed loop air circulation system, substantially sealed off from the ambient air, is provided for the flow of air into and out of the grinder/pulverizer station. A cryogenic liquid or gas is injected into the grinder/pulverizer station in a sufficient amount to both maintain the temperature in the grinder/pulverizer station below that of the temperature of combustion of the material being processed, while at the same time purging enough oxygen from the atmosphere of the grinder/processor station to keep the level of oxygen below that required for combustion of the material at a temperature greater than the temperature of processing being maintained. In this manner, any chance of combustion of the material being processed during the grinding/pulverizing process is substantially eliminated.

BRIEF DESCRIPTION OF THE DRAWINGS

Various embodiments of the present invention are described in detailed below with reference to the drawings, in which like items are identified by the same reference designation, wherein.

DETAILED DESCRIPTION OF THE INVENTION

Figure 1:
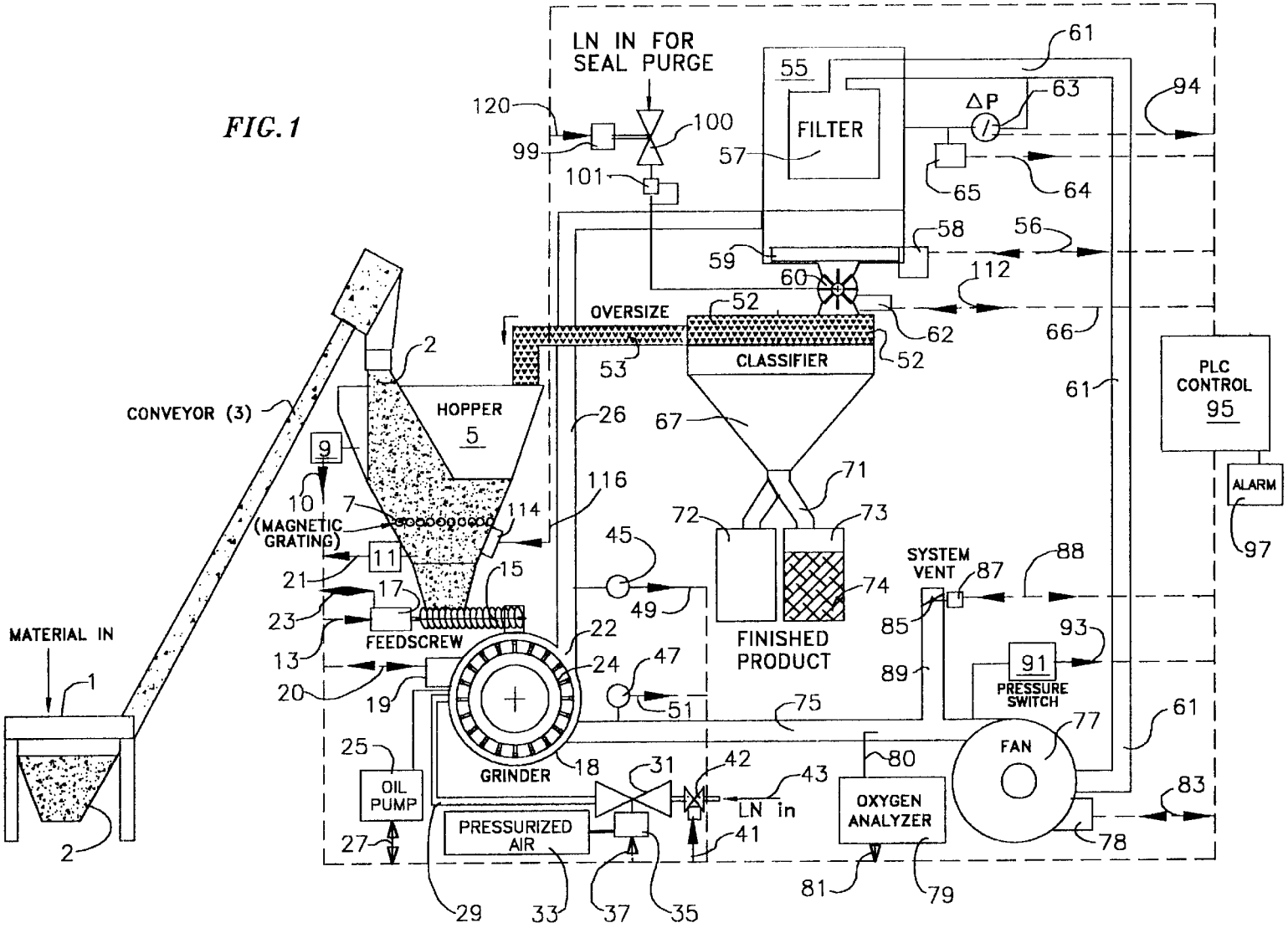
FIG. 1 is a simplified block/schematic diagram of apparatus for one embodiment of the invention.

With reference to FIG. 1, in one embodiment of the invention, a grinding and/or pulverizing system is provided, for grinding materials including but not limited to organic materials such as herbal plant leaves, roots, branches, and so forth. As will be described in greater detail, the system can be placed under completely automatic control via the programming of a Programmable Logic Control (PLC) 95, or the system can be further programmed by a PLC 95 for selectively permitting semiautomatic or manual control of various components.

Material 2 to be processed is delivered into a conveyor hopper 1. A screw conveyor 3 is operated for conveying the material 2 from conveyor hopper 1 into a storage hopper 5. In this example, the conveyor 3 is a Series 500 Helix Conveyor, manufactured by Hapman Conveyors, of Kalamazoo, Mich. The conveyor 3 is manually controlled for moving a sufficient amount of material 2 into storage hopper 5. The storage hopper 5 is made large enough to hold sufficient material 2 for continuous batch processing by the system. A magnetic grating 7 is positioned in a mid-section of the storage hopper 5 for removing metallic particles from the material 2 before it is delivered to the grinder 18. In this example, the magnetic grating is a Model No. GS1430CR, and is manufactured by Bunting Magnetics located in Newton, Kans. A high-level sensor or bin indicator 9 outputs a high-level signal 10 to PLC 95 if the material 2 in storage hopper 5 exceeds a predetermined level, for automatically disabling operation of a drive motor (not shown) of conveyor 3 to prevent additional material 2 from being delivered into storage hopper 5. Also, a low-level sensor or bin indicator 11 is included for providing a low-level signal 21 to PCL 95 for indicating that material 2 has bridged in storage hopper 5.

Material 2 from storage hopper 5 is gravity fed, in this example, to a mill feedscrew 15 driven by a motor 17 in response to a drive signal 13 from PLC 95. The mill feedscrew 15 is a Model No. 28HJSF, and is manufactured by Jacobson, Inc. located in Minneapolis, Minn., in this example. The feedscrew 15 is operated to deliver material 2 into grinder 18. In this example, the grinder 18 is a Jacobson Air Swept Pulverizer Model No. 28-H, manufactured by Jacobson, Inc., located in Minneapolis, Minn., in this example. Also in this example, a 150 HP (horsepower) motor 19 under the control of PLC 95, drives grinder 18. An oil pump 25, in this example a Model No. JASP28, and is manufactured by Fauver Engineered Systems located in Kentwood, Mich., is used in this example to pressure lubricate grinder 18. Note that PLC 95 monitors via signals 20 the magnitude of current Im of grinder motor 19, for insuring that motor 19 is operating in a predetermined range of current magnitude for proper operation of grinder 18. Also, the oil pump 25 provides pressure proving and motor overload signals 27 to PLC 95 to permit the latter to terminate operation of grinder 18 if the pressure goes out of specification, or the motor 19 becomes overloaded. Note that the feedscrew motor 17 is controlled by PLC 95 monitoring signals 23, in this example, by changing the frequency of a variable frequency controller (not shown) for changing the speed of motor 17 to in turn control the rate at which the feedscrew 15 is turning. The chamber 22 of grinder 18 is included within a substantially closed path system for air and product flow, as will be described in greater detail below. Grinder 18 also includes cutting and pulverizing mechanism 24, shown simplistically in this example.

An air duct 75 is used for carrying air from a fan 77 into grinder chamber 22. The fan is driven by motor 78 under the control of PLC 95. PLC 95 sends a digital turn-on signal via signal path 83 to the motor starter (not shown) for turning on motor 78, whereafter the motor starter sends back a digital signal to PLC95 to indicate that the motor starter has applied power to motor 78. Note that a pressure switch 91 monitors the flow of air in duct 75, for providing a digital signal 93 to PLC 95, the signal being indicative operation of fan 77 or the flow of air in duct 75. Note the entire closed loop air circulation system as described herein is substantially sealed off from the ambient air.

Side branch duct 89 has one end connected to duct 75, and its other end open to the ambient air, for providing a system vent. A butterfly-valve 85 is moved between open and close positions via a butterfly-valve controller 87, the latter being under the control of PLC 95, via signal 88. In this manner, PLC 95 operates butterfly 85 for controlling the level of system pressure via air vented into the atmosphere from duct 89, at any given time.

An oxygen analyzer 79 has a probe 80 installed in air duct 75 to sample air flowing therethrough. The oxygen analyzer 79 provides a signal 81 to PLC 95 indicative of the percent oxygen in the air of duct 75 being delivered to grinder chamber 18. Partly in response to signal 81, PLC 95 provides a signal 37 to control or modulate the air pressure applied from a source of pressurized air 33 to a valve controller 35 operating a valve 31, to control the injection of liquid nitrogen (LN) being delivered via a feed line 43. A secondary blocking valve 42 is added for shut off redundancy. The latter are controlled by a signal 41 from PLC 95 for allowing LN into valve 31, for passage into nitrogen feed line 29 for delivering the LN into chamber 22 of grinder 18. The temperature of air flowing in duct 75 is monitored via temperature thermocouple 47 that provides a temperature signal 51 to PLC 95. Also, the temperature of air flowing through outlet duct 26 from chamber 22 of grinder 18 is monitored by another thermocouple 45 that provides an outlet air temperature signal 49 to PLC 95. In turn, PLC 95 is programmed to control the amount of liquid nitrogen (LN) being injected into grinder chamber 22, in order to keep the level of oxygen and temperature within the enclosed system in a range that substantially prevents any chance of combustion of the material 2 being processed. Note that the permissible ranges of temperature and oxygen level may vary in accordance with the type of material being processed, in that various materials may have different temperatures of combustion relative to a given level of oxygen and surrounding air. Note that in a prototype system of the present invention, the chamber temperature could be set to a desired temperature in a range from 30° F. to 90° F., and the oxygen level was fixed to 10% oxygen, but these parameters can be changed for a given application.

As shown, outlet duct 26 has its other end connected to open into a dust collector 55 that includes an air filter mechanism 57. In this example, the filter mechanism 57 includes five hundred-twenty-five square feet of dust bag area for filtering air passing therethrough. In filter chamber 55, air passes through filter 57, and flows into return duct 61 for passage to fan 77, in the closed looped airflow system as now described. Note that fan 77 actually causes a vacuum to be formed in return duct 61 for pulling air through the closed loop airflow system, rather than pushing air through the system.

Note that a transducer 65 is provided for monitoring the static pressure within filter chamber 55, and outputting a static pressure signal 64 to PLC 95. Also, a pressure gauge 63 is connected between return duct 61 and filter chamber 55 for providing a digital signal 94 to PLC 95. If the digital signal 94 is indicative of excessive differential pressure between return duct 61 and filter chamber 55, PLC 95 is programmed to shutdown operation of the system, as will be described in greater detail below. When such excessive differential pressure occurs, this is typically indicative of the need to replace the filter mechanism 57.

Within filter chamber 55, ground material falls to the bottom of the chamber and collects over a stirrer mechanism 59 driven by a motor 58 that is turned on via a digital on signal via signal path 56, from PLC 95 to the associated motor controller, which returns a digital signal to PLC 95 via signal path 56 to indicate that power has been applied to the motor. The stirrer 59 is provided in this example by a Horizontal Unloading Valve (HUV) Model No. HV-40, manufactured by M. Paradowski & Associates, located in Piscataway, N.J. The stirrer 59 allows ground material to flow into a rotary air lock valve 60 driven by a motor 62. The motor 62 is controlled by PLC 95 via sending a digital signal 112 along signal path 66 to operate an associated motor controller to apply power to motor 62, which controller (not shown) also returns a digital signal on signal path 112 to advise PLC 95 that power has been applied. The rotary air lock valve 60 is operated by PLC 95, as programmed, for maintaining a desired air pressure within the filter or dust collector chamber 55, while at the same time permitting ground material to flow from filter chamber 55 into a centrifugal sifter or classifier 52, also known as a sifter. In this example, the classifier 52 is provided by a Model CSM 1130 Sifter, manufactured by Gericke LTD, located in Lanks, England. The classifier or sifter 52 gravity feeds a finished product 74 into a chute 67, and also delivers oversized ground product or material 2 into a duct 53 for delivery back into storage hopper 5, for subsequent further grinding or pulverizing, as previously described. The finished product 74 or ground material 2 or ground material 2 delivered from chute 67 via a manual diverter 71 into a shipping container 73. Note that as shown, through use of a manual diverter 71, after the container 73 is filled with a finished product 74, the diverter 71 is used to cause the finished product 74 to then be delivered from chute 67 into an empty shipping container 72, while at the same time a new empty shipping container 73 is placed into position for receiving the finished product 74 after shipping container 72 is filled.

Further note the use of a pressure switch 91 for monitoring the pressure in duct 75, to provide a pressure signal 93 to PLC 95. If the pressure sensed is less than 0.15 inches of water column (IWC), PLC 95 responds by shutting down the system as shown and described for FIG. 6.

As indicated, PLC 95 is programmed to monitor a number of different signals indicative of various conditions in the system. If the PLC 95 senses that the system is operating outside of a desired range, operation of the system is shutdown. Dependent upon the severity of the alarm condition, alarm 97 will be activated alone for a less severe condition, and for fatal alarm conditions the system will also be shut down. In all cases a message will be delivered to the touch screen of PLC 95 to indicate the alarm condition.

In this example, the Programmable Logical Controller (PLC) 95 is provided by an Allen Bradley Model Nos. SLC502 PLC, and a Panelview 550 MMI manufactured by Allen Bradley, located in Milwaukee, Wis.

During operation of an experimental engineering prototype of the subject system, it was discovered that ground material 2 would at times become clogged in the rotary air lock 60. To eliminate this problem, a solenoid operated valve 100, controlled by controller 99, which in turned is controlled by a signal 120 from PLC 95, is used for injecting liquid nitrogen (LN) through a regulator 101 into the rotary valve 60, on a continuous basis during operation of rotary valve 60, for preventing material 2 from clogging the rotary valve 60. The various steps in operating the present system, including of programming of PLC 95, will now be described.

Figure 2:
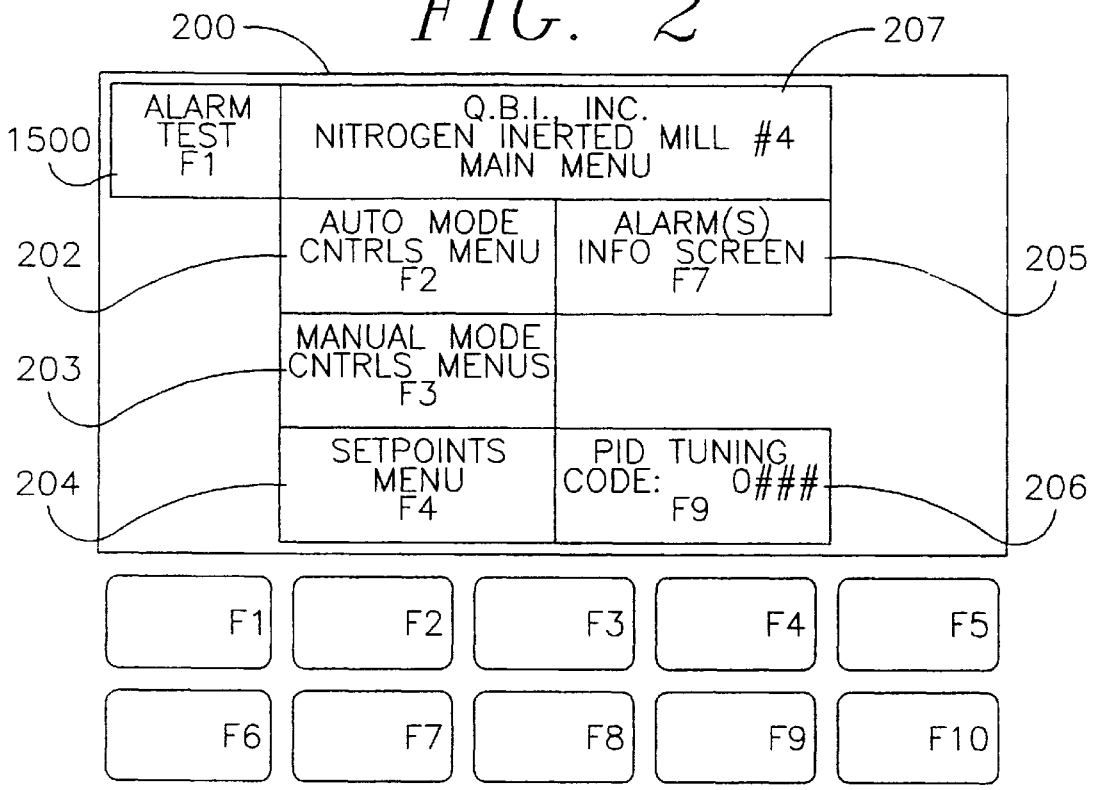
FIG. 2 shows a display screen as viewed on a touch screen for the Man Machine Interface (MMI) of a Programmable Logic Controller (PLC) of an embodiment of the invention.

With reference to FIG. 2, a default screen for a Man Machine Interface (MMI) is shown. PLC 95 includes a touch screen 200, and a plurality of membrane switches F1 through F10 located immediately below touch screen 200. Virtual information or data, and touch screen virtual pushbutton switches can be displayed at desired positions on screen 200 via programming of PLC 95. For a given display ten virtual pushbutton switches can be displayed and made redundant with an individual selected one of the membrane switches F1 through F10, respectively, to permit an operator to use a membrane switch if the corresponding virtual pushbutton is inoperative on touch screen 200. In this example of a default screen, virtual pushbutton switches 1500 and 202 through 206 are provided in touch screen 200 for calling up menus, information screens, alarm testing, or tuning proportional integral derivatives as indicated on various of the labeling provided for the switches 1500 and 202 through 206. Also, information is displayed in sector 207.

For simplicity, in FIGS. 15 through 24, showing other MMI displays, respectively, on touch screen 200, the membrane switches F1 through F10 are not shown. However, the latter are always present, as previously indicated.

Figure 3:
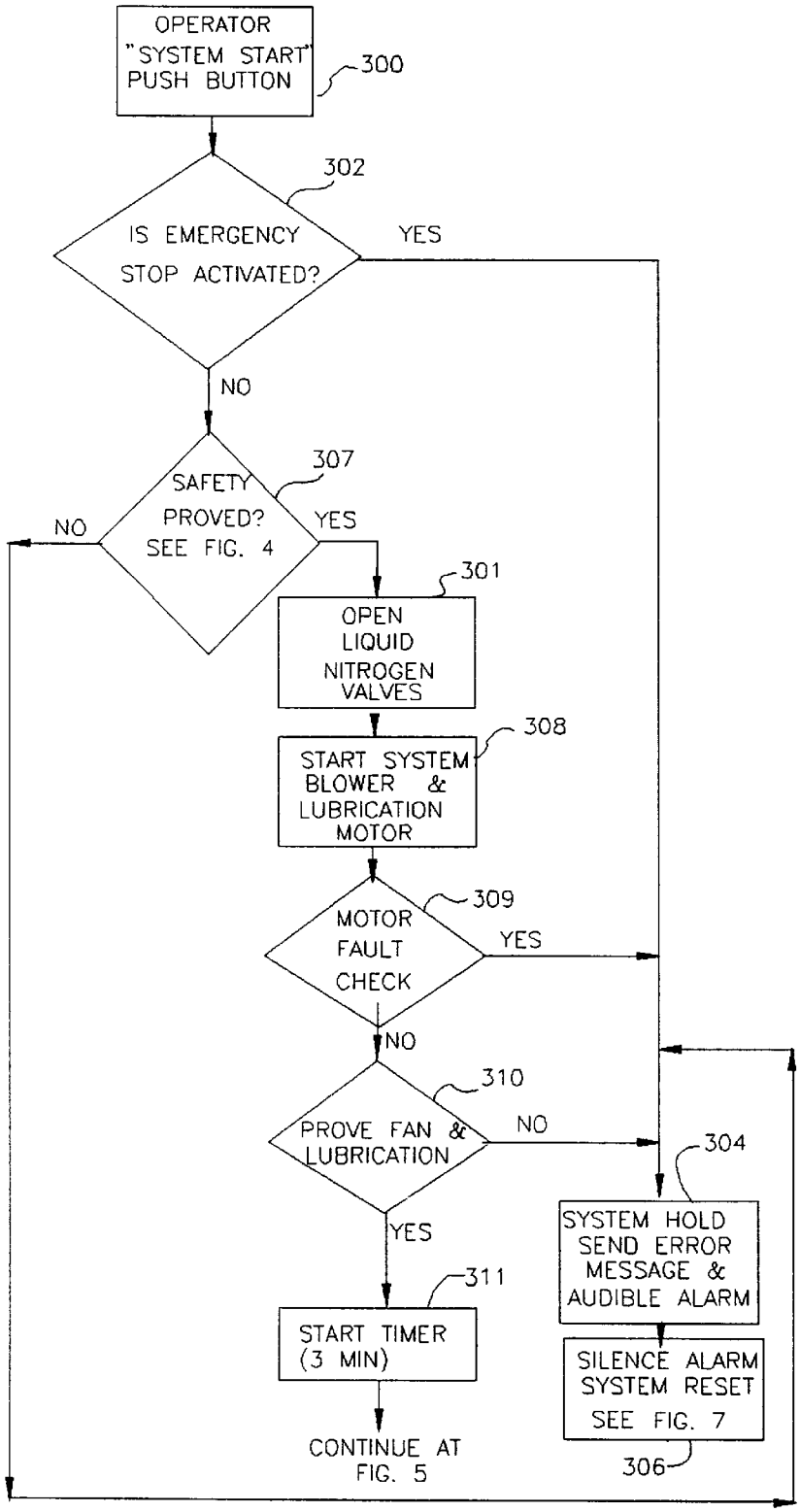
FIG. 3 shows a flowchart of a PLC start-up sequence for one embodiment of the invention.
Figure 7:
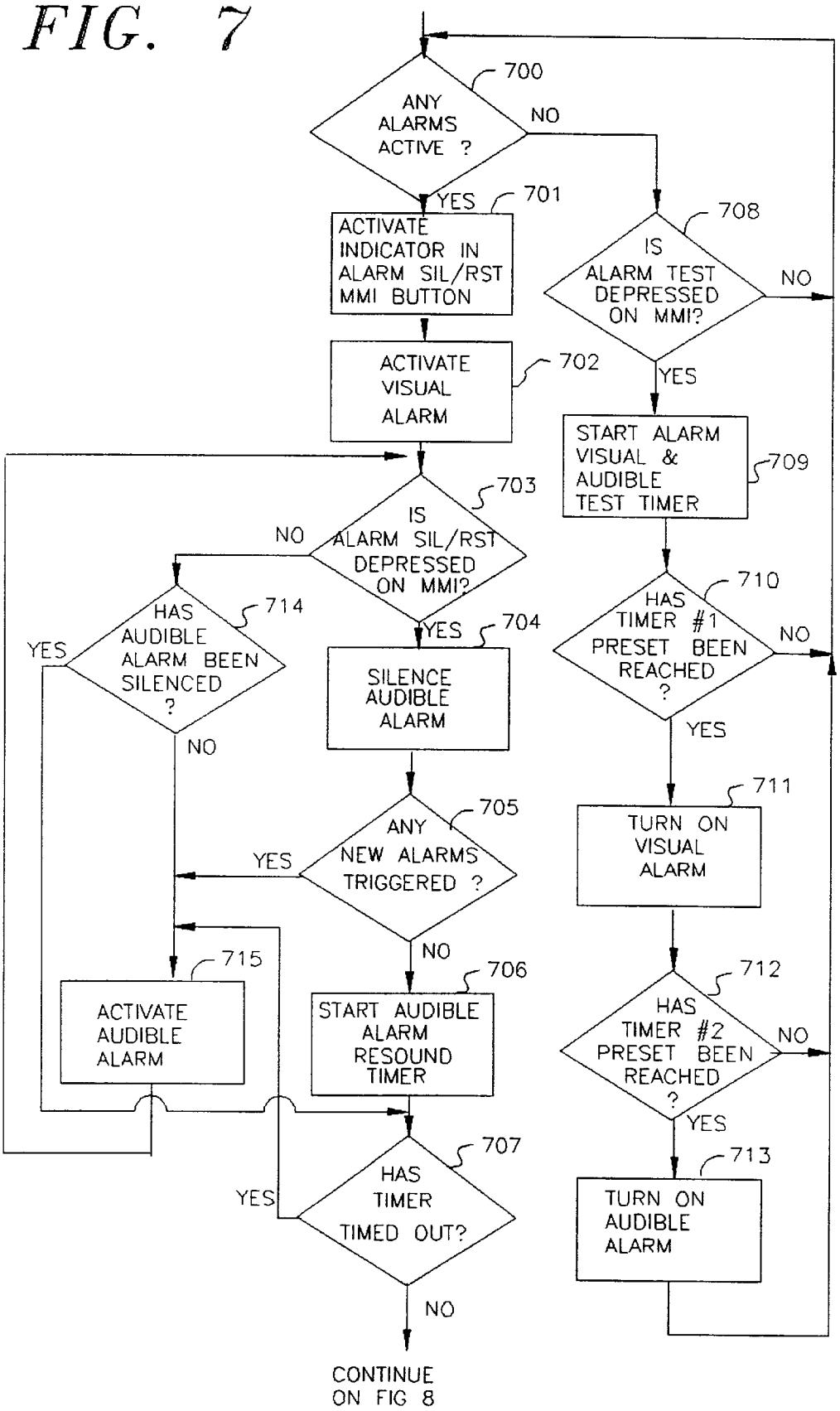
FIG. 7 shows a flowchart for a subroutine for monitoring an alarm system for an embodiment of the invention.
Figure 8:
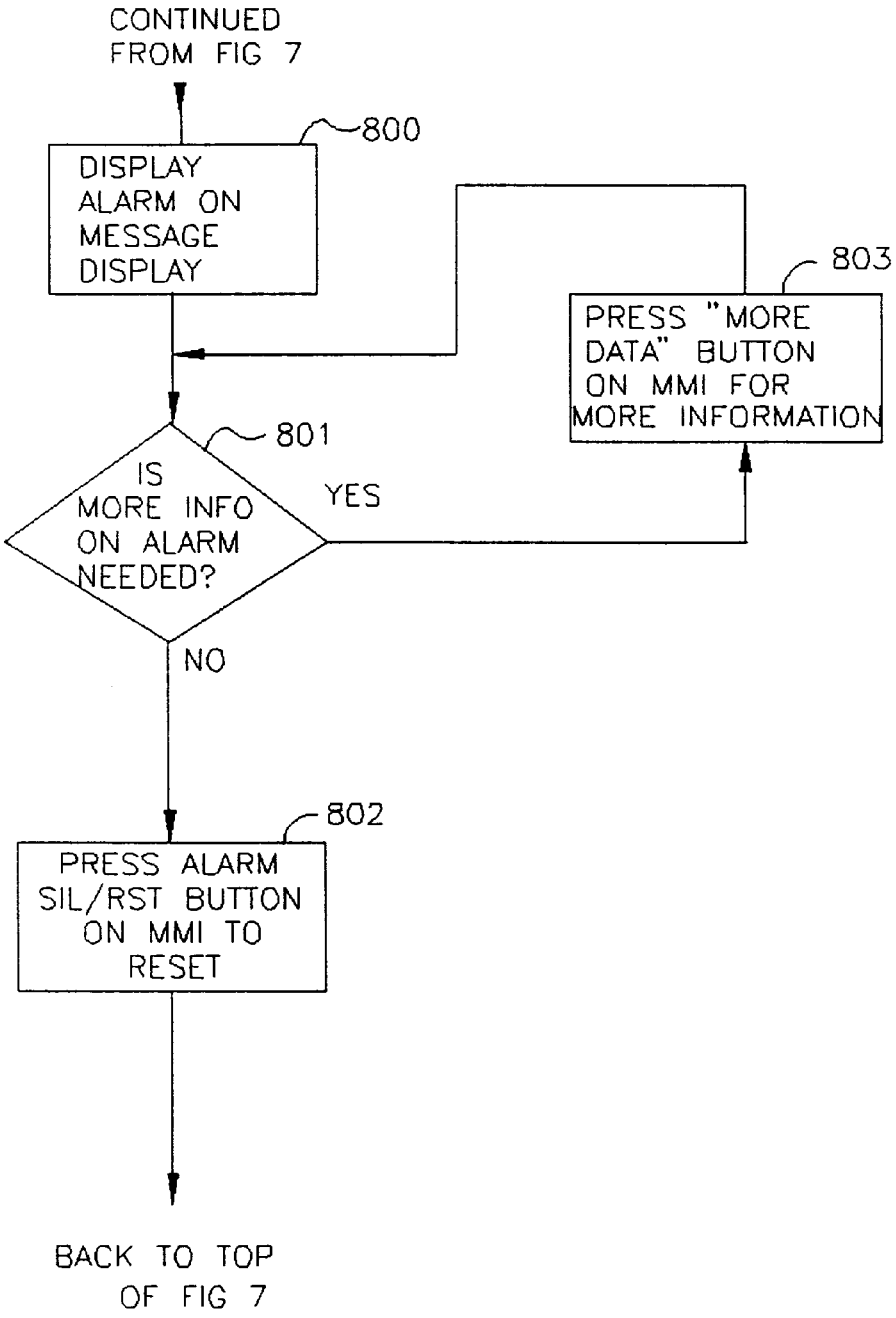
FIG. 8 is a continuation of the flowchart of FIG. 7.

In order to safely operate the present system, it is necessary to program the PLC 95 for a start-up sequence, as shown in FIG. 3. As previously mentioned, the PLC 95 includes a touch screen display 200, which will display symbolically the start-up sequence push buttons that must be addressed, and will also display messages showing the system status, error messages, alarms, and so forth. The operator initiates the start-up sequence by pushing a "system start" push button as shown in step 300. The PLC 95 is programmed to respond by entering into the programming steps shown in the flowchart, and associated flowcharts as will be described. As shown, the PLC 95 is programmed to first scan the present system to determine if any fault conditions exist. If in decision step 302 it is determined that an emergency stop has been activated in the system, steps 304 and 306 are sequentially carried out, as indicated. Step 306 requires a subroutine of steps to be carried out as shown in FIG. 7, wherein decision step 700 is first entered for determining if any alarms are active. As shown, if alarms are active, steps 701 and 702 are sequentially carried out, and then decision step 703 is entered for determining whether an alarm reset button has been depressed on the MMI or touch screen display being presented at the time. If the alarm reset button has been addressed on the touch screen, step 704 is carried out for turning off the audible alarm (see alarm 97 in FIG. 1), and decision step 705 is entered to determine if any new alarms have been triggered. If not, step 706 is carried out, followed by decision step 707 to determine whether a software-generated timer has timed out. If not, another subroutine must be entered as shown in the flowchart of FIG. 8. In the latter subroutine, steps 800 through 802 are carried out if sufficient alarm information has been provided by the system. If not, as shown in step 801, step 803 must be entered for the branch routine shown and a loop is performed between steps 801 and 803 until sufficient information has been obtained in the system, permitting step 802 to then be entered for alerting the operator to press an alarm reset button. The program then returns to step 700 shown in FIG. 7, and if it is determined that in step 700 that no alarms are active, then steps 708 through 713 are sequentially carried out, unless in step 710 it is determined that a preset number "one" has not been reached and control loops back to step 700, or if it is determined that in step 712 preset number "two" has not been reached, control also loops around to step 700. As shown, if the preset has been reached in step 710 a visual alarm (not shown) is turned on. If in decision step 712 it is determined that preset number two has been reached, an audible alarm is turned on via step 713, by activation of alarm 97. Note that in steps 710, the preset number one is 2.5 seconds. Also, in step 712 the preset number two is represented by 5.0 seconds. In each case, a fixed preset value is programmed into PLC 95, and the accumulated time must reach the preset before an alarm is turned on.

With further reference to the flowchart of FIG. 7, if in decision step 703 it is determined that an alarm reset has not been depressed on the MMI, decision step 714 is entered to determined whether the audible alarm 97 has been silenced. If so, decision step 707 is entered, and carried out as previously described. However, if in decision step 714 it is determined that the audible alarm 97 has not been silenced, by activation of a reset in step 703, then step 715 is entered for activating the audible alarm for any alarms triggered subsequent to a Silence/Reset pushbutton, and the control loops back to step 703, as shown.

Figure 4:
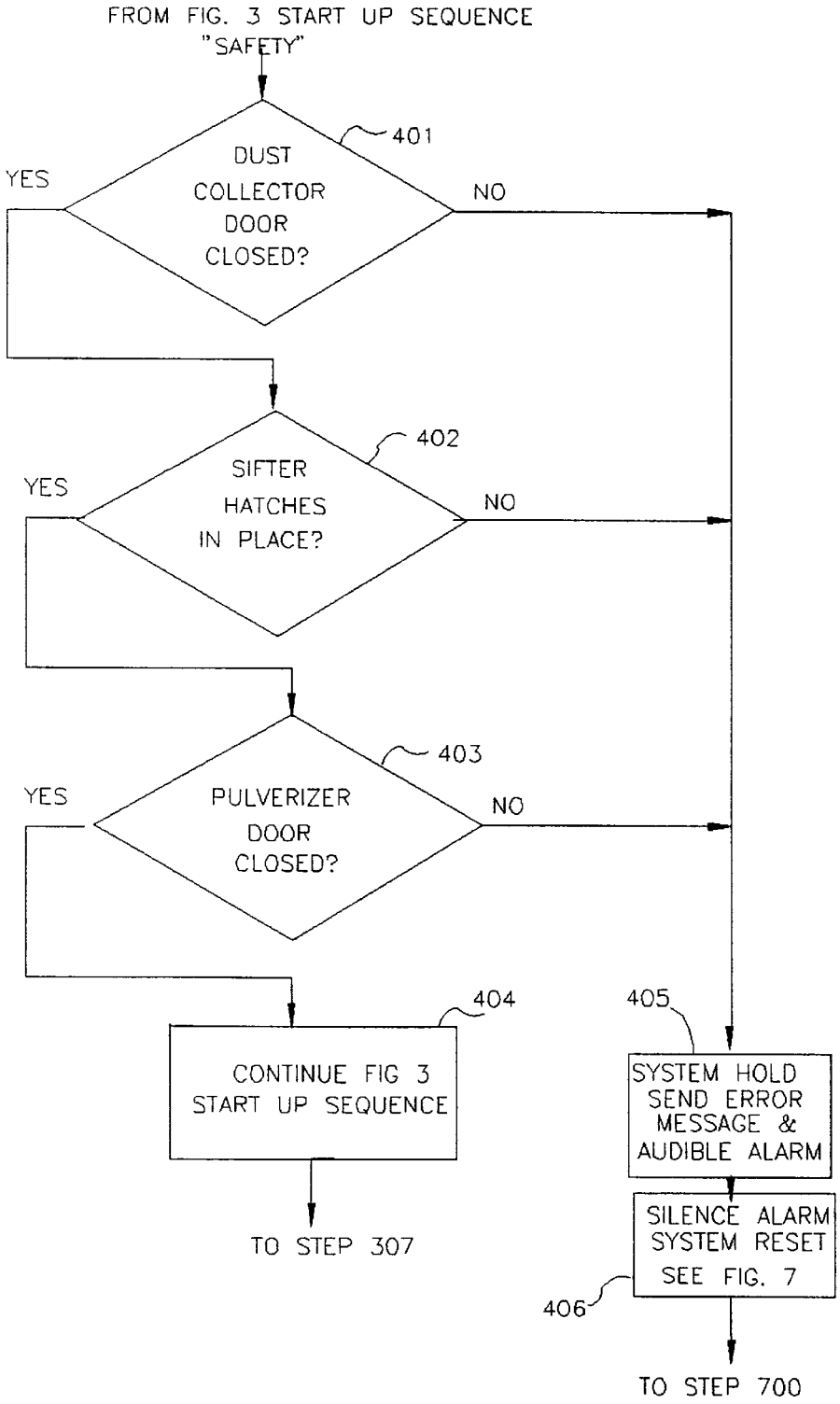
FIG. 4 shows a flowchart for a subroutine of steps for determining whether safety measures have been activated for insuring safe operation of the system before permitting further activation of subsequent start-up steps in one embodiment of the invention.

If in step 302 it is determined that an emergency stop is not activated, step 307 is entered, which is another decision step for proving that the program safety measures have been carried out. To accomplish this, the subroutine shown in the flowchart of FIG. 4 is entered for steps 401 through 406. As shown, first step 401 is entered to determined whether the door of the dust collector 55 is closed. If the door (not shown) is closed, decision step 402 is entered to determine whether hatches (not shown) of sifter or classifier 52 are in place. If they are, step 403 is entered to determined whether the door (not shown) of grinder or pulverizer 17 is closed. If the answer is yes, than step 404 is entered to return to step 307 of FIG. 3. However, if in any one of steps 401 through 403 it is determined that the doors or hatches are not closed or in place, steps 405 and 406 are entered, as shown. Note that step 406 requires a return to step 700 of FIG. 7. If all of the safety measures of step 401 through 403 had been confirmed to be in place, as shown in step 404, control is returned to step 307 of FIG. 3.

Figure 5:
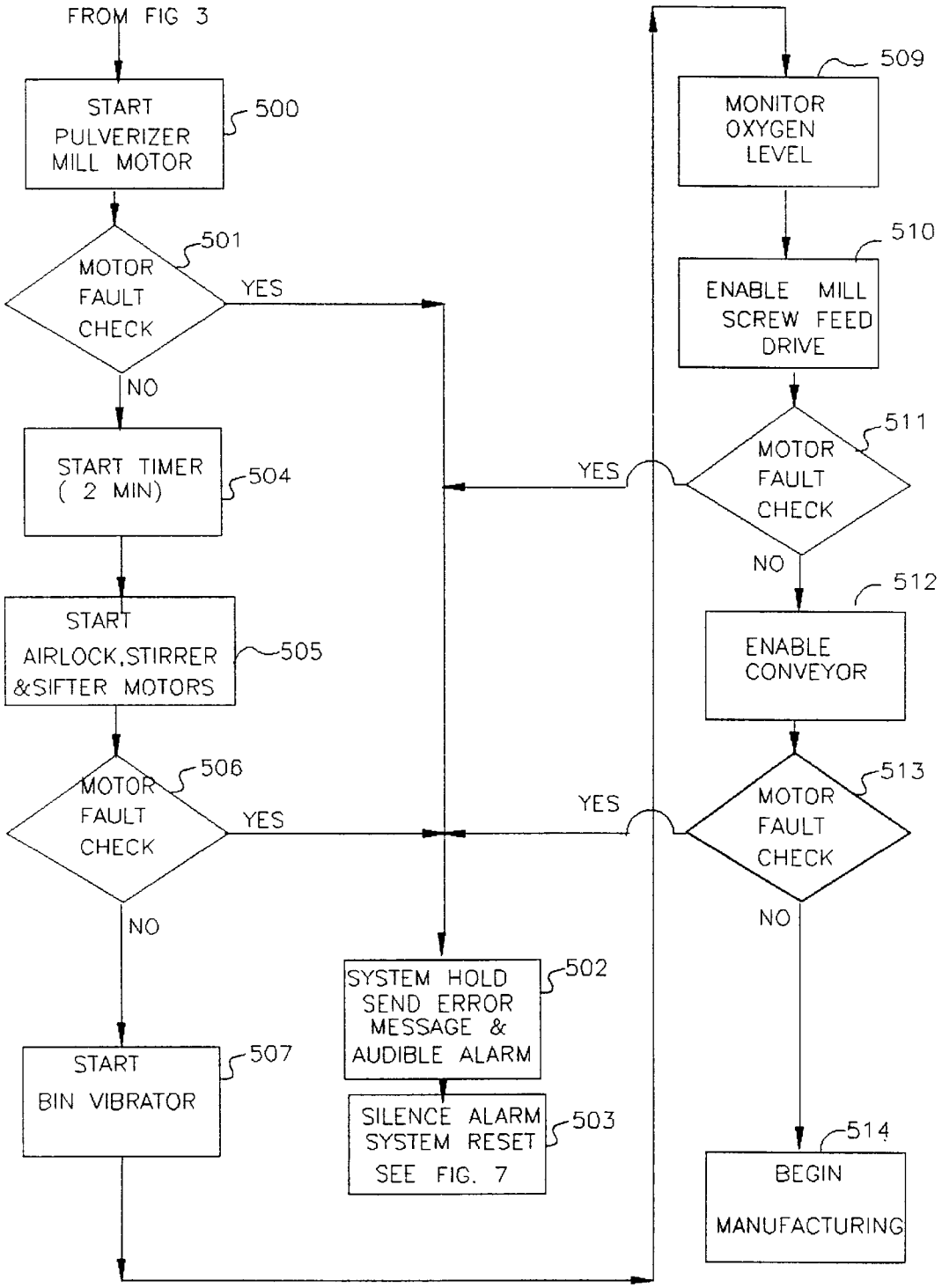
FIG. 5 is a continuation of the flowchart of FIG. 3.

If in step 307, it is determined that the safety measures of the subroutine of FIG. 4 have been taken, first step 301 is taken for opening liquid nitrogen valves 31 and 100, and secondary blocking valves 42 and 101. Next, step 308 is entered for starting up the various blowers and lubrication motor of oil pump 25, whereafter decision step 309 is entered to determine whether power has been applied to the associated motors. If a motor fault is detected in step 309, then as shown in steps 304 and 306 are carried out as previously described. If no motor faults are found in step 309, than step 310 is entered for confirming that the fan 77 is operating, and that the oil pump 25 is properly operating. If not, steps 304 and 306 are entered as previously described, and if so, than step 311 is entered for starting a programmable timer for a time period of three minutes in this example. At the termination of the three minute time period in step 311, control is continued for the start-up sequence for the steps shown in the flowchart of FIG. 5, which is a continuation of the start-up routine. In step 500, the pulverizer mill or grinder motor of grinder 17 is energized, followed by step 501 for determining whether the motor of the grinder 17 is in a fault condition. If the answer is yes, steps 502 and 503 are sequentially carried out, with step 503 requiring that control transfer to the subroutine for the alarm flowchart of FIG. 7, as previously described. Alternatively, if in step of 501 it is determined that the grinder motor is operating properly, step 504 is entered for starting a programmed timer for a period of two minutes. After the two minutes have elapsed, step 505 is entered for starting or applying power to the motors of the rotary air lock 60, the stirrer 59, and the sifter or classifier 52. Next decision step 506 is entered for checking to insure that the motors activated in step 505 are not operating in a fault condition. If the answer is yes, that anyone or more of the motors are operating in a fault condition, steps 502 and 503 are entered and carried out as previously described. If the motors are operating properly and no faults are detected, step 507 is entered for starting a bin vibrator 114. The bin vibrator 114 (see FIG. 1) is energized by the application of an operating voltage on line 116 from PLC 95, as shown in FIG. 1. Next, via step 509, PLC 95 begins monitoring signal 81 for the oxygen level detected by the oxygen analyzer 80 in the air flowing into chamber 22, via duct 75, as previously explained. Next, in step 510 the drive motor 17 of feedscrew 15 is activated via signal line 13 for causing the feedscrew 15 to turn to deliver material 2 from storage hopper 5 into chamber 22 of grinder 18. The feedscrew drive motor 17 is next monitored in step 511 to determine whether it is faulty, and if so steps 502 and 503 are entered as previously described, and if not step 512 is entered for enabling the operation of conveyor 3. In step 513 the motor (not shown) for conveyor 3 is checked for faulty operation, and if faulty, steps 502 and 503 are entered as previously described, and if not faulty continuous manufacturing then begins as represented by step 514, and "SYSTEM RUNNING" is displayed in 1513 of the MMI of FIG. 15.

Figure 6:
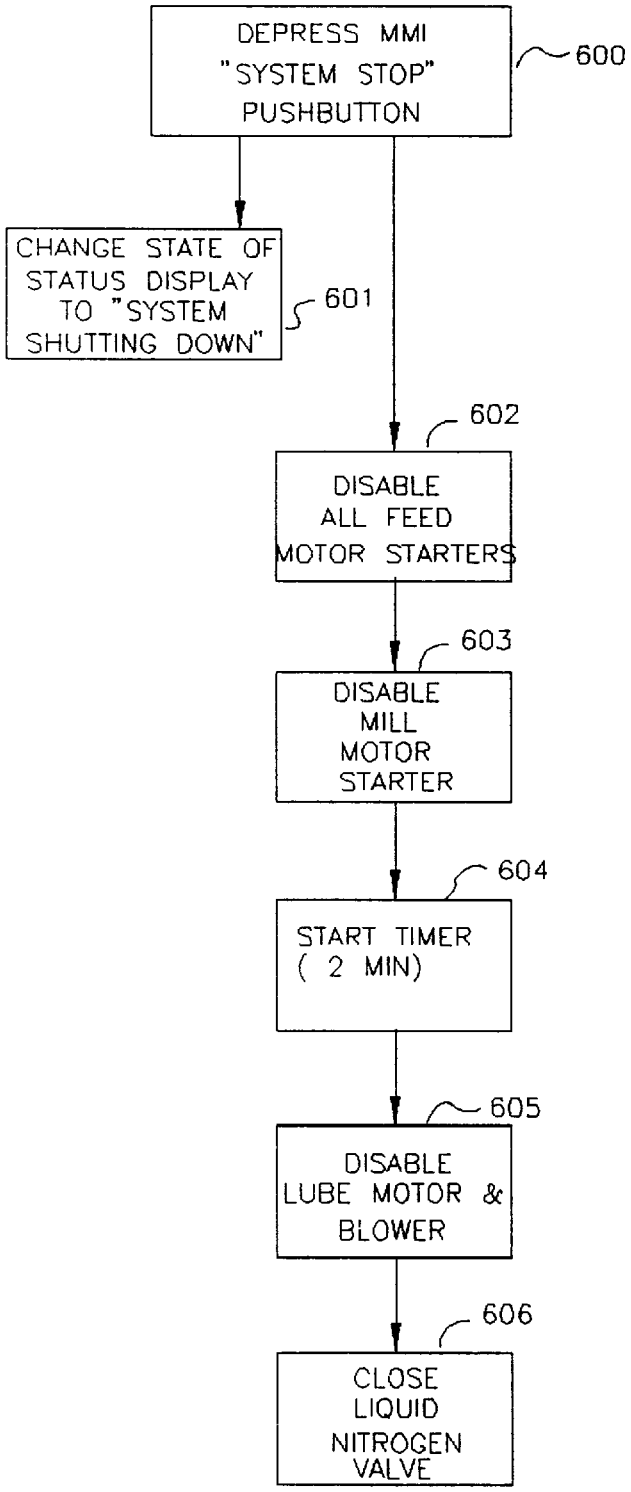
FIG. 6 is a flowchart for a shutdown sequence for an embodiment of the invention.

At any time the present system is operating in a normal manufacturing mode, as represented by step 514 (see FIG. 5), the system can be shutdown by going through a standard shutdown sequence as shown in the flowchart of FIG. 6. In order to initiate a standard shutdown sequence, a system operator addresses the MMI via the touch screen 200 of PLC 95 to depress a "System Stop" pushbutton, as shown in step 600. Note that in the MMI of FIG. 15, after switch 1504 is pressed for "SYSTEM START", the switch display changes to "SYSTEM STOP", and if switch 1504 is thereafter depressed the system will be shutdown as indicated in step 601. Also, step 602 is entered for disabling all feed motors, such as the motor for conveyor 3, the motor drive 17 for feedscrew 15, the motor drive 58 for stirrer 59, the motor drive 62 for rotary air lock 60, and the motor (not shown) for classifier 52. Next, the motor drive 19 for grinder 18 is disabled in step 603, followed by a programmed time duration of two minutes via step 604. After the two minute duration in step 604, step 605 is entered for disabling the motor for oil pump 25, and the motor drive 78 for fan 77. The shutdown is completed in the next step 606 for closing nitrogen valve 31 to terminate the injection of liquid nitrogen into chamber 22 of grinder 18, while at the same time closing valve 100 and disabling regulator 101 for terminating the flow of liquid nitrogen into the rotary air lock 60.

Figure 9:
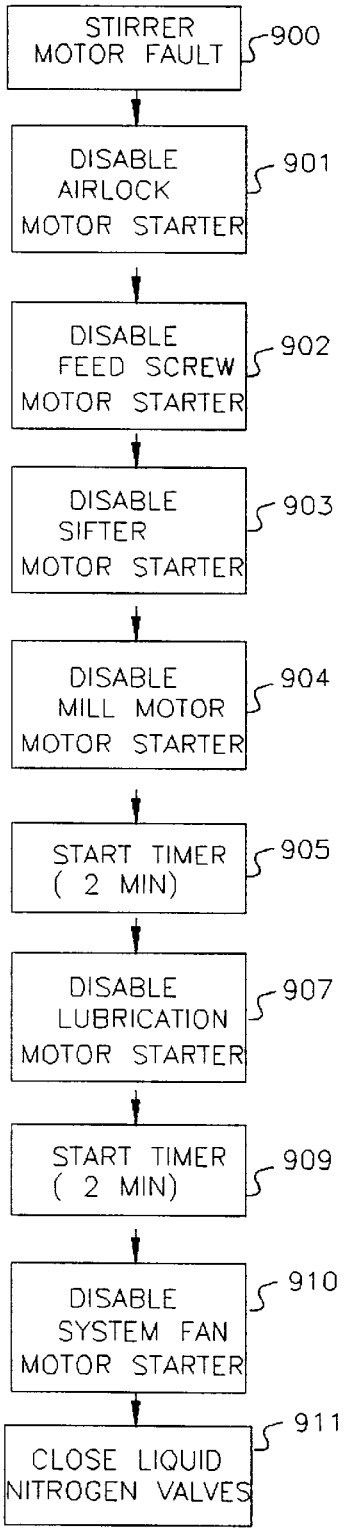
FIGS. 9 through 12 show flowcharts for component failure shutdown sequences for a stirrer motor fault, feed-screw motor fault, air lock motor fault, and sifter motor fault, respectively.
Figure 10:
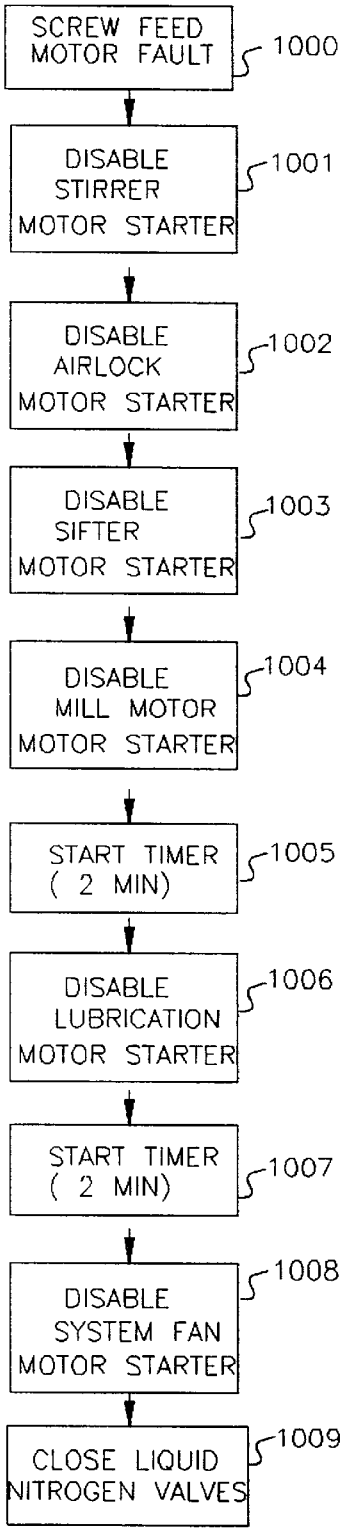

At all times during the manufacturing process, the PLC 95 is programmed to continuously monitor each of the major systems components for fault conditions. If a fault occurs in a specific major component, a specific shutdown procedure must be followed by PLC 95. Steps 900 through 905, 907, and 909 through 911, are sequentially performed by PLC 95 in the event of a stirrer motor 58 failure, as shown in the flowchart of FIG. 9. Similarly, if in step 1000 of the flowchart of FIG. 10, a fault is detected in the feedscrew motor drive 17, steps 1001 through 1009 are sequentially performed by PLC 95 for shutting down operation of the system.

Figure 11:
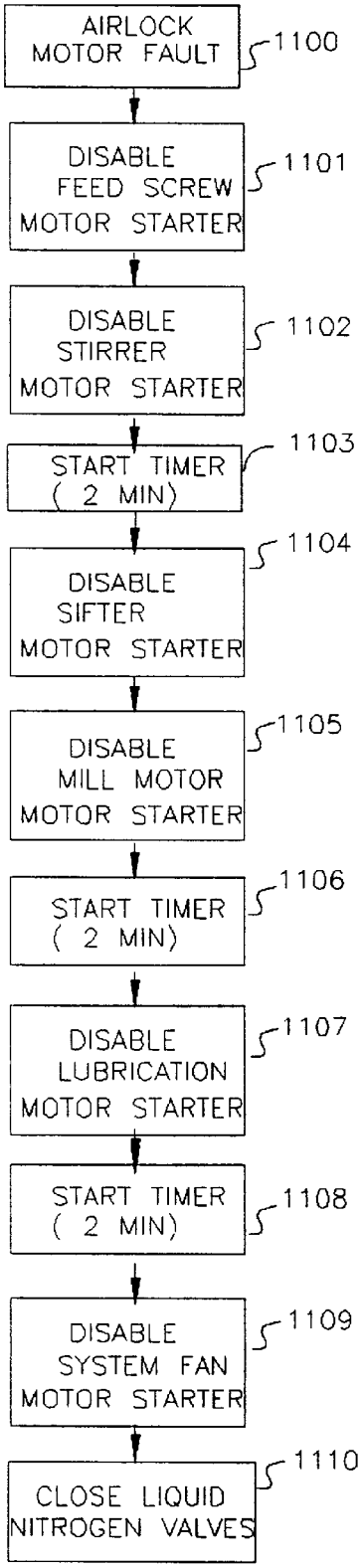

The flowchart of FIG. 11 shows the system shutdown steps if a fault condition is detected in step 1100 in the operation of the motor drive 62 for the rotary air lock 60. If such a fault is detected, then as shown, steps 1101 through 1110 are performed by the programming of PLC 95 to shutdown the present system.

Figure 12:
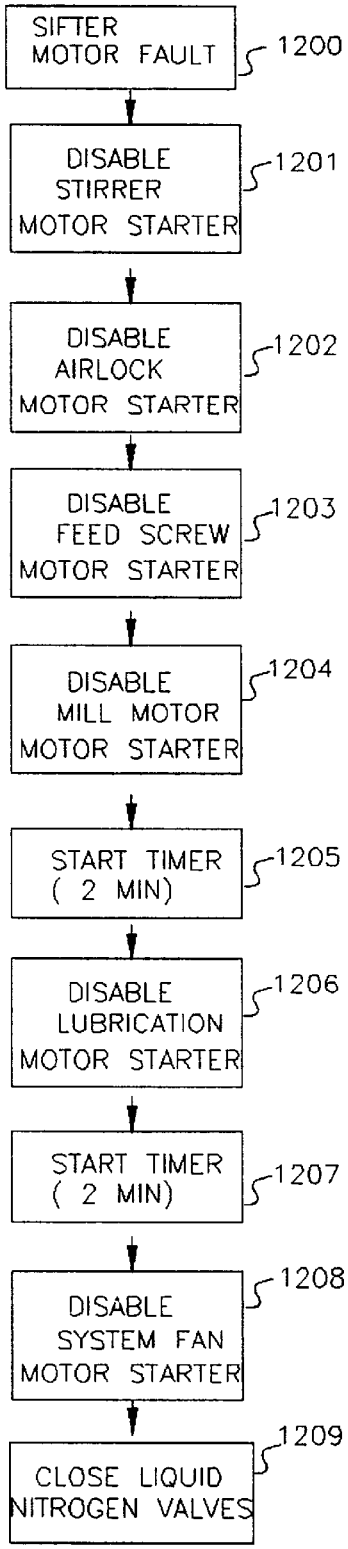

If a fault condition is detected in the operation of the motor drive for the sifter or classifier 52, as indicated via step 1200 in the flowchart of FIG. 12, another shutdown procedure is entered into by PLC 95. More specifically, steps 1201 through 1209 are sequentially performed by PLC 95 to complete the system shutdown.

Figure 13:
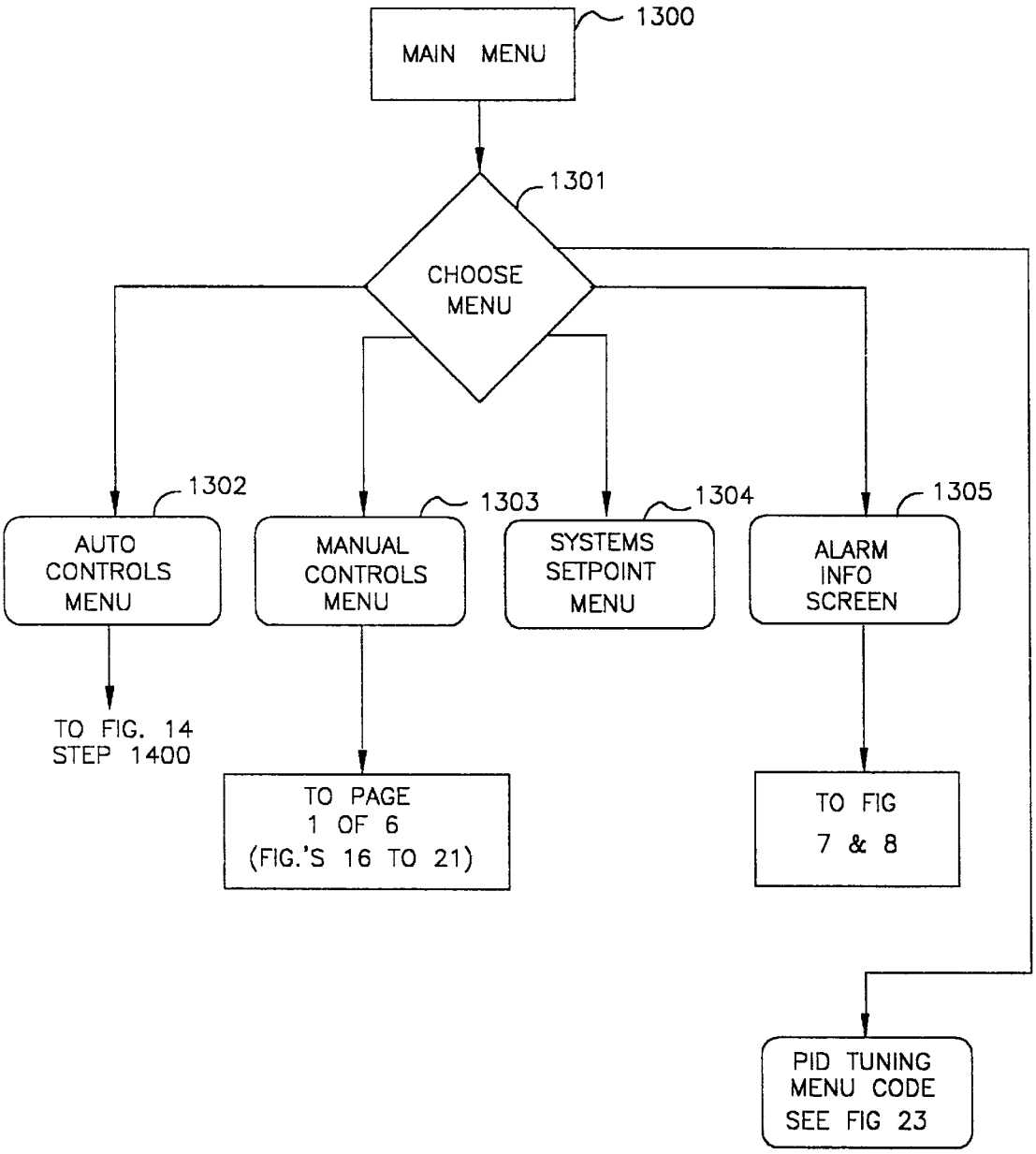
FIG. 13 shows a flowchart for a Man/Machine Interface (MMI) flowchart for permitting an operator to select via a touch screen either one of an "AUTO CONTROLS MENU", or "MANUAL CONTROLS MENU", or "SYSTEMS SET-POINT MENU", or "ALARM INFORMATION SCREEN", or "PID TUNING MENU CODE", respectively, for an embodiment of the invention.

In FIG. 13, a flowchart for the programming steps for the MMI for selecting a given mode of operation is shown. First, in step 1301, an operator is prompted to "Choose Menu" via the display of virtual pushbuttons on the touch screen 200, each labeled 1302 through 1305, as shown. If the pushbutton 1302 is addressed, control is transferred to step 1401 of the "Auto Controls Menu" shown in the flowchart of FIG. 14. In the mode for "Auto Controls Menu", an operator has a choice of selecting one of plurality of modes of operation or entry, as shown. More specifically, if an operator depresses a displayed pushbutton "System Start" 1402, the MMI will operate STATUS display 1513 (see FIG. 15) to display one of three states of operation via step 1403. As shown, the three states a "System Starting Up" 1404, or a "System Running" 1405, or a "System Shutting Down" 1406. However, when in the "Auto Controls Menu" of FIG. 14, an operator must first select the control method indicated by step 1407, by pushing either button 1408 for selecting control of the percent oxygen level of the air in chamber 22 to be a preprogrammed ten percent oxygen, or pushbutton 1409 can be depressed for having the PLC 95 operated to control the outlet temperature or temperature in chamber 22 of grinder 18. The PLC 95, under either oxygen level control 1408 or outlet temperature control 1409, will operate to maintain the oxygen level and/or temperature by controlling the amount of liquid nitrogen injected into the chamber 22 of grinder 18, as previously described. Note that as shown in the MMI of FIG. 15, a single pushbutton switch 1505 is used to provide switches 1408 and 1409 through programming of PLC 95, for toggling between percent oxygen or temperature. Alternatively, as previously mentioned, the PLC 95 can be programmed to insure that sufficient liquid nitrogen is injected into chamber 22 at all times for keeping the oxygen level at or below ten percent, and the outlet temperature below a preset temperature. After the control method 1407 is selected, the operator can next proceed to either activate the "System Start" pushbutton 1402, as previously described, or "System Setpoint Menu" pushbutton 1410, or to provide "Alarm Information Screen" via pushbutton 1411, or go into a control mode represented by 1412 for selecting either an "Auto" control mode via a pushbutton 1413, or a "Manual" mode via pushbutton 1414.

Figure 14:
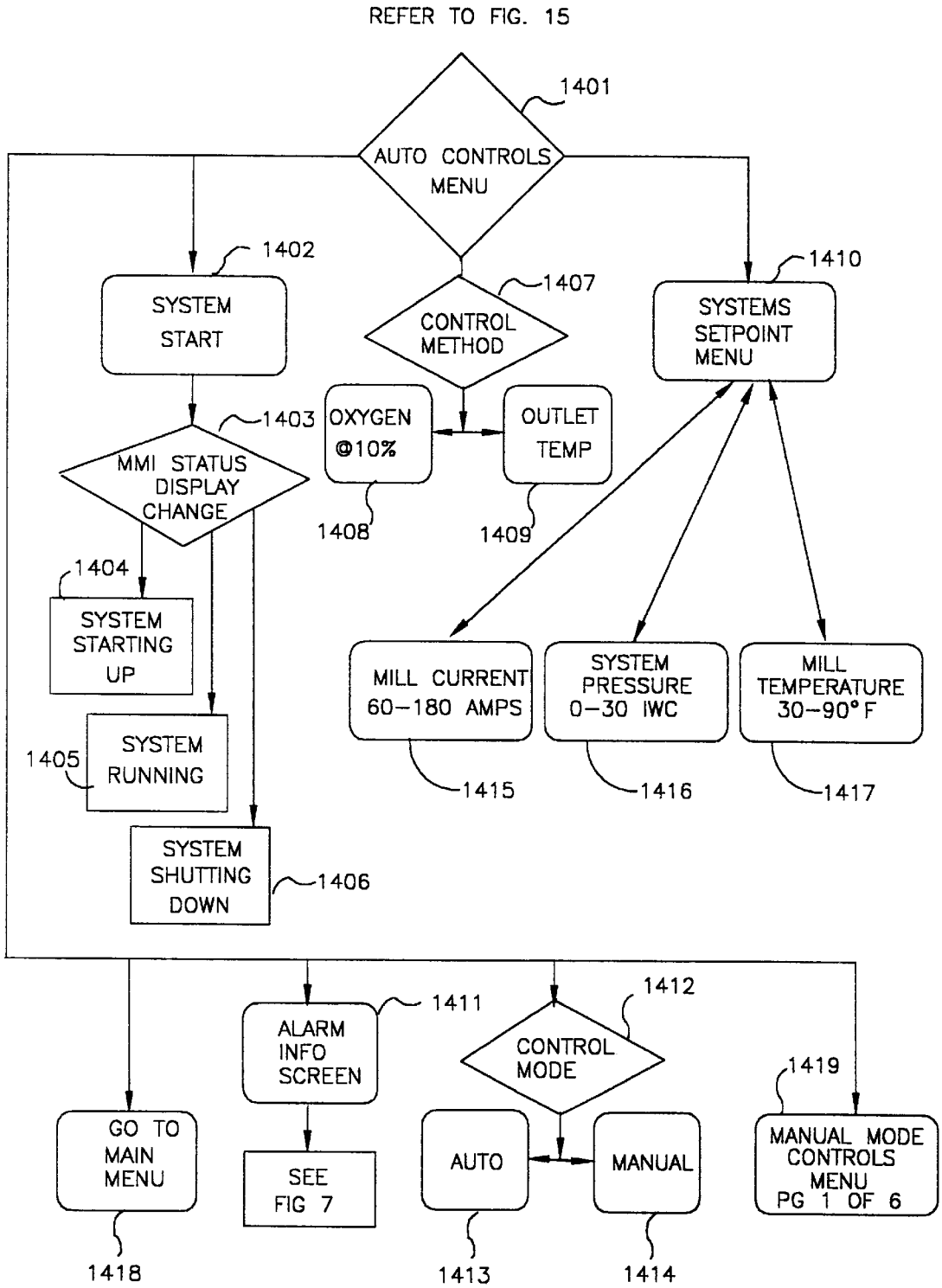
FIG. 14 shows a flowchart for an MMI for permitting an operator to manually select various modes of operation of the system, for within given ones of the modes controlling certain set point parameters, or for initiating various aspects of operation of a chosen mode.
Figure 15:
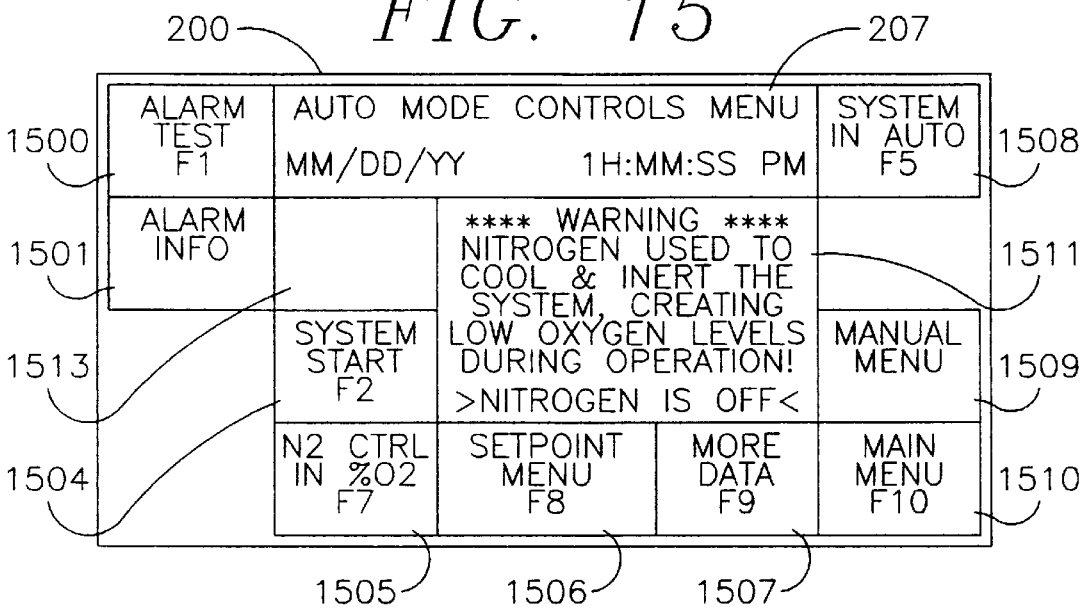
FIG. 15 shows an MMI display screen for a system "AUTO MODE CONTROLS MENU" for an embodiment of the invention.

If in the "Auto Controls Menu" of FIG. 14, an operator elects to press the "Systems Setpoint Menu", 1410, the PLC 95 will respond by providing three displays, namely "Mill Current" 1415, "System Pressure" 1416, and "Mill Outlet Temperature" 1417 representative of the temperature within the chamber 22 of grinder 18. By toggling the "System Setpoint Menu" pushbutton 1410, the operator will be able to select via display 1415 a desired mill current setpoint in a range between 60 to 180 amperes, in this example. Similarly, via the display 1416, the operator will be able to select a system pressure between 0 through 30 Inches of Water Column (IWC). Lastly, via display 1417, the "Mill Outlet Temperature" can be set to a temperature from 30° F. to 90° F. Note that a pushbutton 1418 is provided for allowing the operator to return to the "Main Menu" 1300 of FIG. 13. If the operator selects manual control via pushbutton 1414, the display 1419 will be provided, and the operator will be able to toggle through the MMI manual menus shown in FIGS. 16 through 21. These menus can be manually addressed through use of the touch screen 200 and MMI programming, as shown in the flowchart of FIG. 25.

Figure 16:
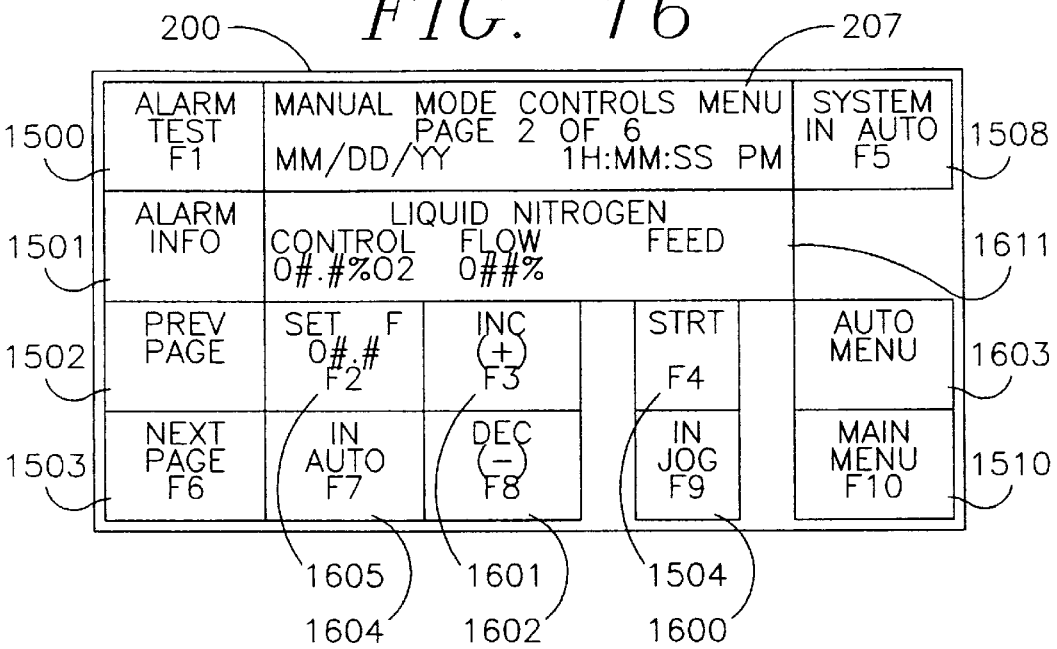
Figure 25:
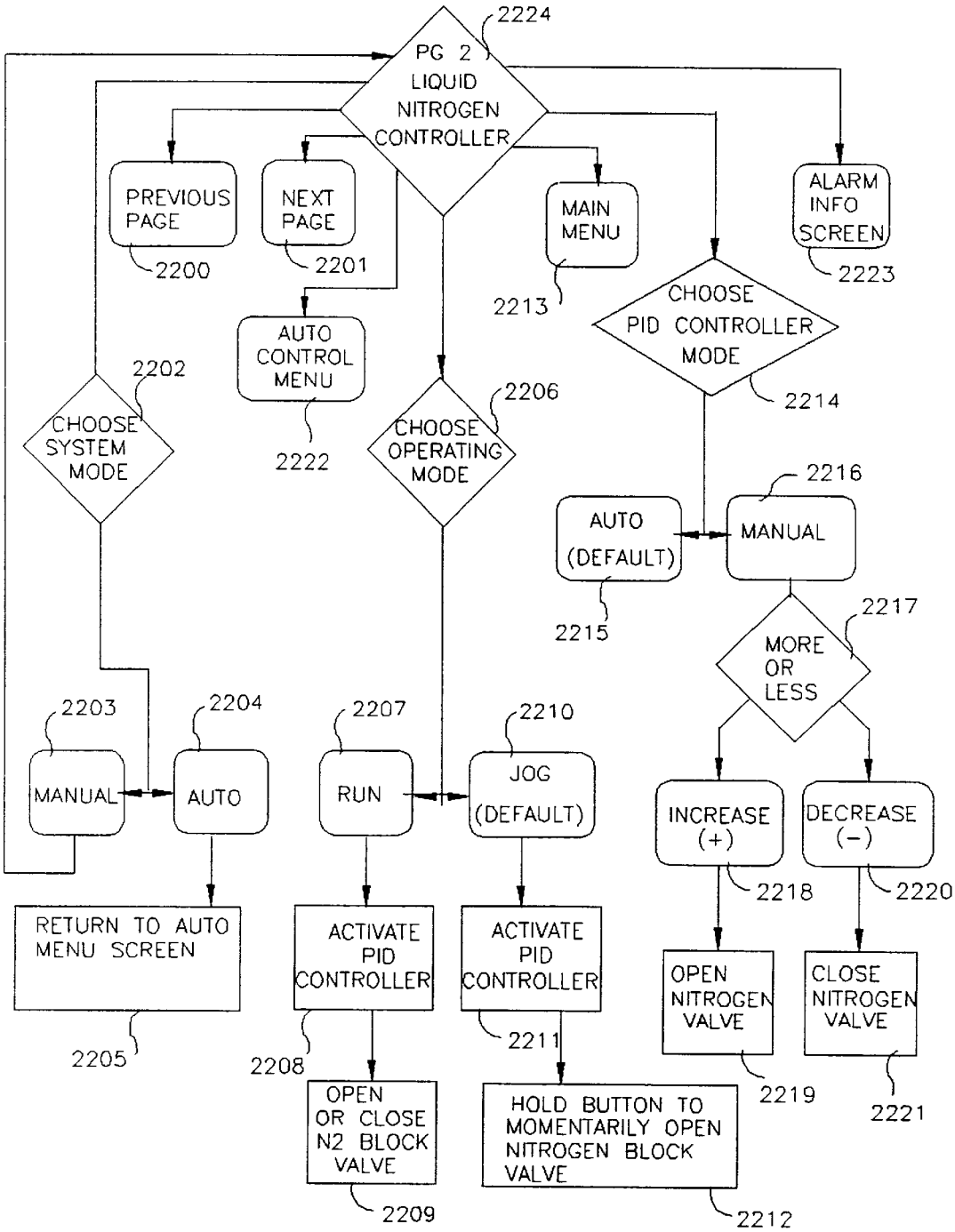
FIG. 25 shows a flowchart for the steps of control loops for permitting control of various analog functions provided by a programmable logic controller of one embodiment of the invention.

With reference to the flowchart of FIG. 25, if the operator has pressed the "Manual Pushbutton" 1414 (see FIG. 14), the MMI presents a display of pushbuttons 2200, 2201, 2203, 2204, 2207, 2210, 2213, 2215, 2216, 2218, 2220, 2222, and 2223, function labeled as indicated. This flowchart is typical of the operation of all control loops for the MMI manual menus of FIGS. 20, 16 and 19. Note that as shown by the diamond symbol 2224 the second display to come up on the touch screen along with the aforesaid pushbutton displays is the "Manual Mode Controls Menu Page 2 of 6", as shown in FIG. 16. If the operator selects next page via pushbutton 2201 (more specifically for the MMI Manual Menu of FIG. 16, the operator pushes pushbutton 1503 of touch screen 200, which is analogous to the generalized pushbutton 2201). Next, by toggling of that pushbutton any one of the menus of FIGS. 16 through 21, respectively, can be selected for the MMI manual menu display. Also, pushbutton 2200 can be used to address a previous one of the menus of FIGS. 16 through 21, respectively. Alternatively, the operator can press pushbutton 2222 to go to the "Auto Control Menu" of FIG. 14, or pushbutton 2213 to go to the "Main Menu" of FIG. 13. Also, pushbutton 2223 can be addressed to display an "Alarm Info Screen" as provided from the steps shown in the flowcharts of FIGS. 7 and 8, as previously described. Alternatively, the "Main Menu" pushbutton 2213 can be addressed for returning to the "Main Menu" of FIG. 13. Also, pushbutton 2203 can be addressed for selecting a completely "Manual Mode of Operation", or pushbutton 2204 can be addressed for returning to the "Auto Menu Screen" via 2205 in association with the flowchart of FIG. 14.

With reference to FIG. 25, if manual operation is selected, then one must choose an operating mode (see 2206) by depressing pushbutton switch 2207 for a "Run" mode, or 2210 for a "JOG" mode. Note that in FIG. 20, pushbutton switch 1600 provides the function of 2207 and 2210, by changing its programmed display and function from "IN JOG" to "IN RUN" when depressed, or from "IN RUN" to "IN JOG" when depressed. When either of these modes are so entered, the next step in either mode, not shown in FIG. 25, is to depress pushbutton switch 1504 (see FIG. 20) labeled "STRT" for START. Thereafter, safety check steps (not shown) similar to the steps of FIG. 4 are carried out, and if a safety problem is detected steps 405 and 406 are carried out. If no safety problems are detected, steps 2208 and 2209 are carried out if in the "RUN" mode, or steps 2211 and 2212 are carried out in the "JOG" mode provided pushbutton 1504 is continuously depressed.

Also, when in the Manual Mode of Operation of FIG. 25, an operator can as shown in 2214 elect to choose the mode for the PID controller by depressing pushbutton 2215 for entering into "AUTO" mode ("DEFAULT"), and the system is programmed to track the setpoints to be described below. Alternatively, pushbutton 2216 "MANUAL" may be depressed, and then via steps 2217 through 2219 increasing the opening of the nitrogen valves 31 and 42, or via steps 2217 through 2221 for closing the nitrogen valves 31 and 42. Note that in the MMI manual menu of FIG. 16, a single pushbutton switch 1604 provides the functions of switches 2215 and 2216 through programmed toggling via programming of PLC 95.

With reference to FIG. 15, an "AUTO MODE CONTROLS MENU" includes the display as shown on the touch screen 200 of the PLC 95. More specifically, the touch screen display 200 includes virtual pushbuttons 1500, 1501, 1504, 1505 through 1510, labeled as shown. Displays 207, 1511, and 1513 are included. It is believed that the labeling is self-explanatory as to the actions that will be taken by addressing a pushbutton, and as to the displays. For example, pushbutton 1500 is labeled "ALARM TEST" in a default condition, and will change to "ALARMS SIL/RST", meaning that if an alarm 97 is sounding or activated, by pushing pushbutton 1500 the alarm will be reset and silenced. In the default condition, this pushbutton is used for testing the alarm system. The menu of FIG. 15 permits an operator to control the temperatures in the chamber 22 of grinder 18. As shown in FIG. 15, the MMI also includes a display section 1511. Display 1511 shows hazard warnings associated with nitrogen operation and various system data, such as pressure level, oxygen concentration, temperatures, setpoints, and the current status of liquid nitrogen operation and usage from one convenient data window. This display is operated with pushbutton 1511 to toggle between the different data displays. Also note as previously described, that an operator can push pushbutton 1505 to change between a temperature control mode or a percent oxygen control mode.

Note further, as previously mentioned for the menu of FIG. 2, to insure reliable operation of the system, the PLC 95 includes membrane pushbuttons F1 through F10 below the touch screen 200. These membrane switches F1 through F10 are shown in FIG. 2, but are not shown in FIGS. 15 through 24 for simplicity, but are redundant to individual virtual pushbuttons of the MMI displays via programming of PLC 95. If one of the virtual switches of any given touch screen display fails to operate, if the display for a particular pushbutton shows at the bottom of the pushbutton symbol an F number, this F number corresponds to one of the membrane switches, which can be operated in place of the corresponding virtual pushbutton in order to provide the switching function indicated. However, not all of the virtual pushbuttons have a redundant membrane pushbutton, as indicated. Certain of the virtual pushbutton functions remains as in the display of FIG. 15, but are reprogrammed for the application of FIG. 16, and accordingly the same reference designation is used, for example.

The Man Machine Interface or MMI manual menus shown in FIG. 20, and FIGS. 16 through 21 will now be described. In this regard, for the various displays shown on the menus on display screen 200, many of the pushbuttons, and certain displays have common functions from one menu to another, and as result for convenience the same reference designation has been used for these pushbuttons and displays. For example, pushbutton 1500 is labeled "ALARM TEST" in a default condition when no alarms are active in the system. At this time, an operator can depress pushbutton 1500 for testing any audible and visual alarm devices in the system. When an alarm becomes active, the labeling of pushbutton 1500 is changed to read "ALARM SIL/RST", and may be then depressed by an operator to silence any audible alarms on a first depression thereof, and reset any triggered alarm messages one at a time with each additional depression of pushbutton 1500 (see FIGS. 7 and 8). Pushbutton 1501 is activated to obtain an alarms information screen on the display (see FIG. 24) to permit an operator to be shown the activated alarms, and possible causes and remedies for any alarm that has been triggered. Pushbutton 1502 is operable for scrolling through the manual mode controls menus pages backwards through pages 6 through 1, for example, and permits repetition of such scrolling. Pushbutton 1503 is operable for scrolling through the manual mode control page 1 through 6 in a forward direction, and then repeating the same. Pushbutton 1508 in a default condition is labeled "SYSTEM IN AUTO" when the system has been placed in an automatic mode of operation, or shows the labeling "SYSTEM IN MAN" when system has been set to be operated in a manual mode of operation. This pushbutton can be toggled to permit an operator to go between automatic and manual operating modes. Pushbutton 1510 can be operated to permit one to go into a main menu (see FIG. 2). Pushbutton 1504 is operable for starting or stopping a specified system device in the manual mode of operation, and is related to the setting of the "IN JOG" labeled pushbutton 1600. Pushbutton 1600 in a default condition is labeled "IN JOG", whereby pushbutton 1504 labeled "START" must be pressed and held in order to start a device, or released to stop a specific device operating in the manual mode. When pushbutton 1600 is labeled "IN RUN", pushbutton 1504 can be depressed and then released to start the device, and pressed and then released once again to stop the controlled device in the manual mode of operation. Pushbutton 1604 in a default condition is labeled "IN AUTO" when the P.I.D. controller is set to operate automatically, or is labeled "IN MAN" when the P.I.D. controller is set to be operated manually. Thereafter, pushbutton 1604 can be pressed and then released to toggle the P.I.D. controller between automatic and manual operating modes. Note that as previously explained, the latter controller is a software controller that is programmed into the PLC 95. Pushbutton 1605 can be pressed for permitting entry of the P.I.D. controller setpiont, and shows the entered value in engineering units. Pushbutton 1601 is enabled and labeled "INC (+)", whenever pushbutton 1604 shows the labeling "IN MAN", and in such switch conditions can be operated to directly increase the setting for the P.I.D. controlled device within a range of 0 to 100 percent of the range of possible control values of that device. Otherwise, the labeling of the pushbutton is blank. Pushbutton 1602 is enabled and shows the labeling "DEC (−)", when pushbutton 1604 shows the labeling "IN MAN", and can be depressed or operated to directly decrease the setting or value of the parameter for the P.I.D. controlled device within a range of 0 to 100 percent of the range of controllable values. Otherwise, pushbutton 1602 is blank or unlabeled. Pushbutton 1603 can be operated for going to the "Automatic Mode Control Menu" of FIG. 15. Pushbutton 2360 can then be operated for permitting a return to the pervious menu.

Figure 20:
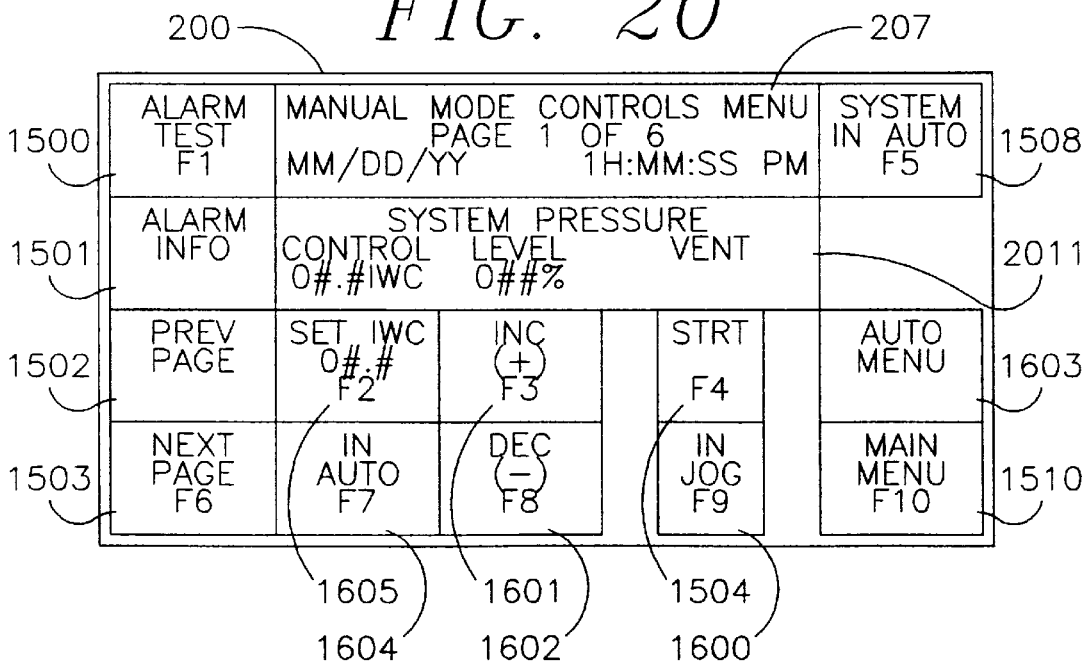
FIGS. 16 through 21, each show the display on a touch screen for various displays for Man Machine Interface manually operable menus, respectively, for different embodiments of the invention.

The first manual mode controls menu, that is the first page "PAGE 1" is shown in FIG. 20. In this display, the display subsection 2011 shows the dynamic process data for the "SYSTEM PRESSURE" closed loop control, for showing the actual IWC value (inches water column), and the percent of full-scale level that the device must be operated at the time in order to attain the setpoint valve shown by the control setpoint value displayed in terms of IWC.

The second page of the MMI menus "PAGE 2" is shown in FIG. 16. Note that display 1611 displays information that is correlated with the operation of pushbutton switch 1505 of the AUTO MODE CONTROLS MENU of FIG. 15. Accordingly, depending on the toggling of pushbutton 1505, display 1611 will either show the dynamic process data for the LIQUID NITROGEN closed loop controller in either percent oxygen, or in degrees Fahrenheit and the percent of full-scale liquid nitrogen flow being obtained at that time.

Figure 17:
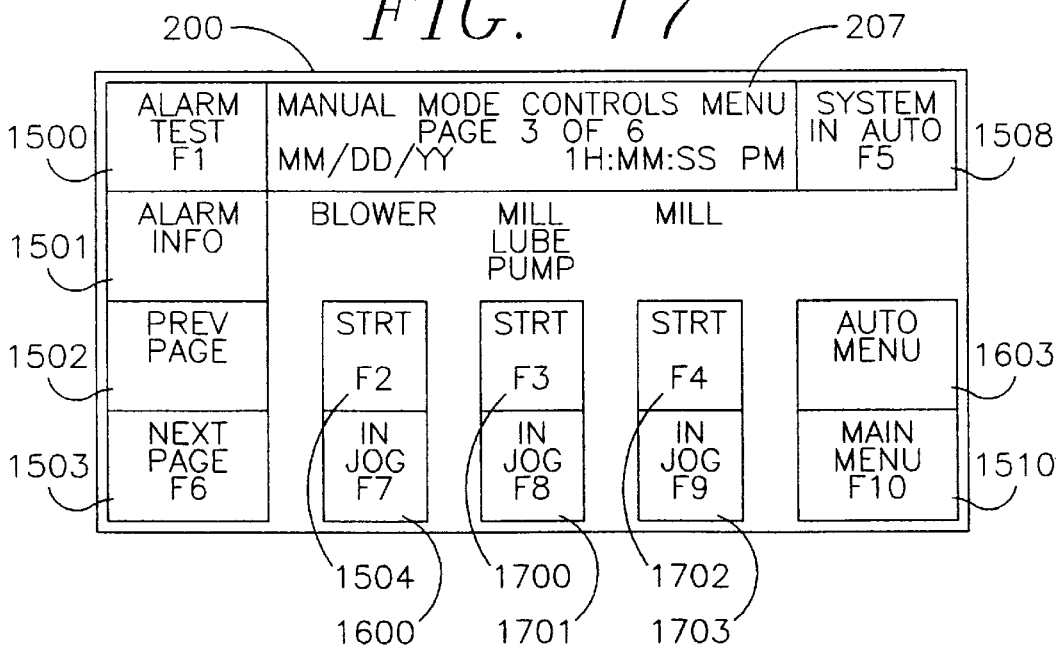

In FIG. 17, the MMI display on the touch screen shown is for providing an operator manual control over the operation of the fan 77 through use of pushbuttons 1504 and 1600, which in this example are located below the display indication "BLOWER" appearing on the information display portion of the menu in the region labeled. Beneath the display indication "Mill Lube Pump" an operator can use virtual switches 1700 and 1701 for manually operating the oil pump 25. Also, located beneath the display "MILL" are two virtual switches 1702 and 1703 for permitting an operator to manually control the operation of the grinder 18.

Figure 18:
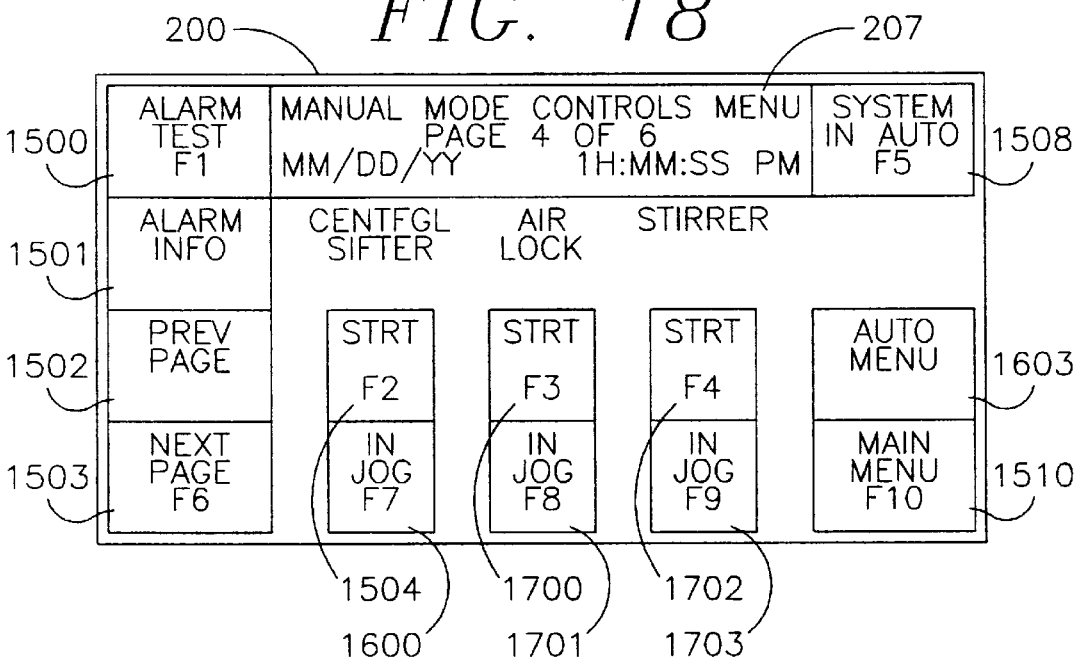

The menu shown in FIG. 18 permits an operator to manually control the operation of the sifter or classifier 52, the rotary air lock 60, and the stirrer 59. Such control is provided through use of the virtual pushbutton 1504 and 1600 beneath the display "sifter" for controlling the classifier 52; the virtual switches 1700 and 1701 below the display "air lock" for controlling rotary air lock 60; and the virtual pushbuttons 1702 and 1703 beneath the display "stirrer" for control of stirrer 52. As would be understood by one skilled in the art, each of the MMI menus described herein have the virtual pushbuttons programmed in the PLC 95 to perform the function indicated for that particular display, such as the operation of the display of FIG. 18.

Figure 19:
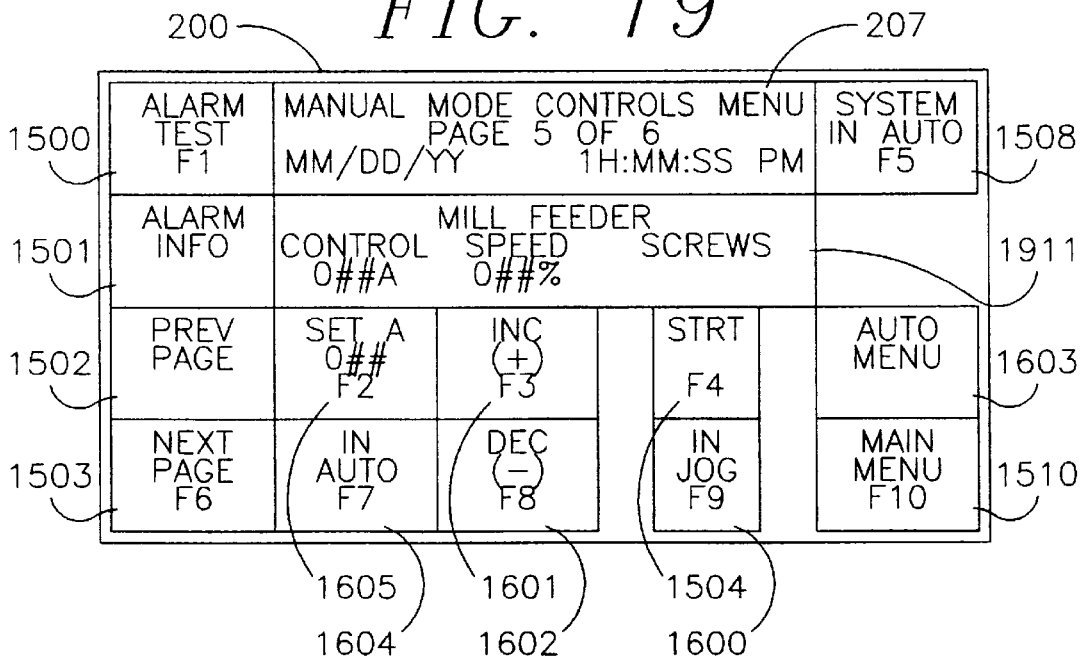

The MMI manual menu is shown in FIG. 19, for the layout of the virtual pushbuttons, is programmed for providing control over the delivery of material to the grinder 18. More specifically, the virtual pushbutton 1504 and 1600 located below the display "MILL FEEDER SCREWS" are used to control the operation of feedscrew motor 17. The virtual pushbuttons 1601 and 1602 located below the display 1911 captioned "MILL FEEDER SPEED" permit an operator to increase or decrease the rotational speed of the feedscrew 15, when the P.I.D. controller is set in the Manual Mode via pushbutton 1604 (see FIG. 19).

Figure 21:
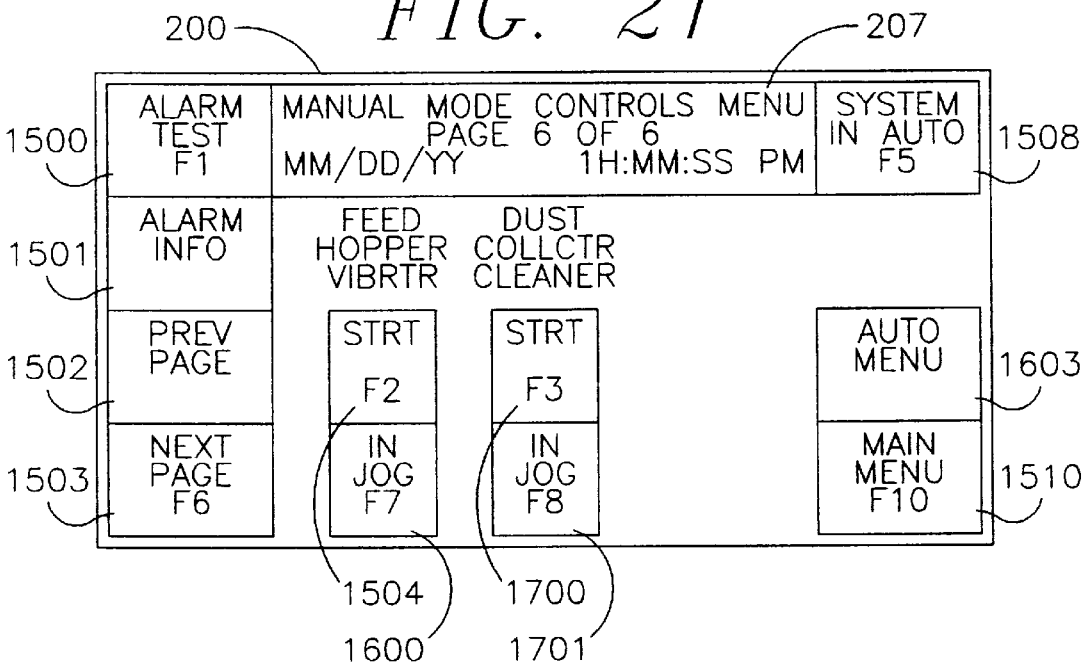

In FIG. 21, the MMI display for the touch screen for permitting the operator to control the vibrator 114 for storage hopper 5, and the cleaning dust collector 55, is shown. The hopper vibrator 114 is controlled via virtual pushbutton switches 1504 and 1600, as shown. The dust collector cleaning operation is controlled via virtual pushbutton switches 1700 and 1701.

Figure 22:
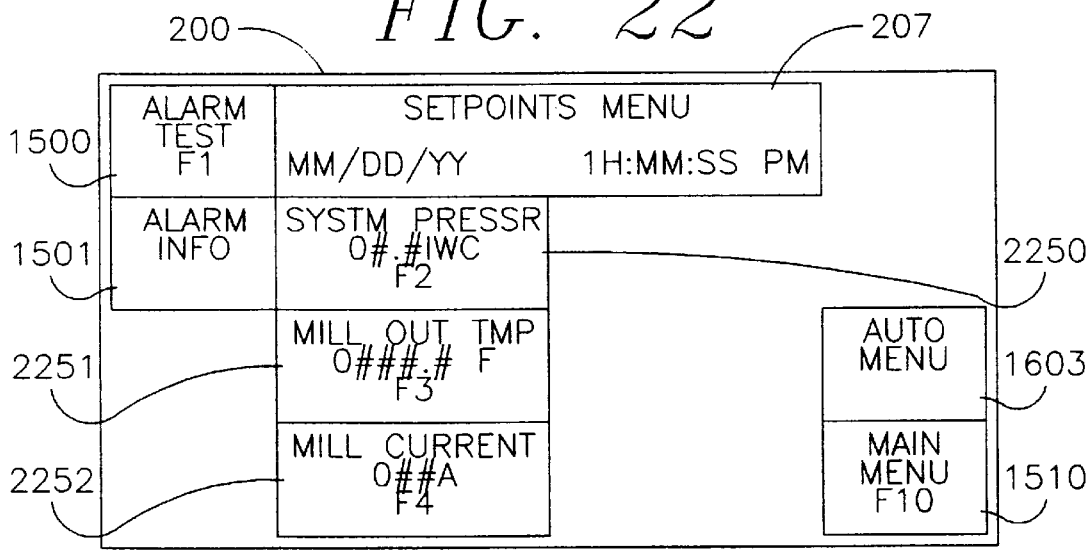
FIG. 22 shows an MMI display screen for a system "SETPOINTS MENU" for an embodiment of the invention.

With reference to FIG. 22, pushbutton 2250 is operable for entering the "SYSTEM PRESSURE" closed loop P.I.D. controller setpoint, and shows the entered value in engineering units (Inches Water Column/IWC). Also, pushbutton 2251 is operable for entering the MILL OUTLET TEMPERATURE setpoint for the liquid nitrogen closed loop P.I.D. controller, and displays the entered value in engineering units (in this case °F.). Pushbutton 2252 is operable for entering the MILL CURRENT setpoint for the mill feeder closed loop P.I.D. controller, that shows the entered value in engineering units (in this case amperes or AMPS).

Figure 23:
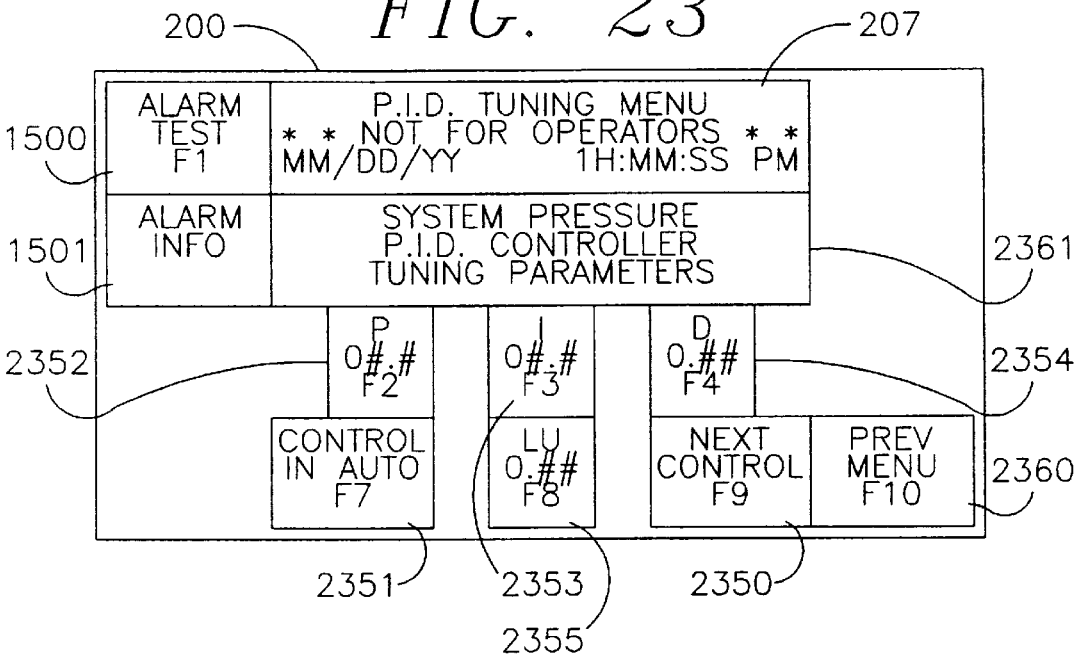
FIG. 23 shows an MMI display screen for a "P.I.D. TUNNING MENU" for an embodiment of the invention.

With reference to FIG. 23, a "P.I.D. TUNING MENU" is shown. Note that pushbutton 2350 is operable as required, for advancing the display 2361, to select a desired P.I.D. controller to tune the P.I.D. by entering the values for the P (proportional) via pushbutton 2352, and the integral via pushbutton 2353, and the derivative via pushbutton 2354. Display 2361 shows the P.I.D. controller selected by operation of pushbutton switch 2350, for tuning purposes. Pushbutton 2351 is labeled "CONTROL IN AUTO" when the selected P.I.D. controller is set to operate automatically, or will be labeled "CONTROL IN MAN" when the controller is set to be operated manually. This pushbutton can be depressed and then released in order to toggle the selective P.I.D. controller between the automatic and manual operating modes. Note that pushbutton 2352, as previously mentioned, is operable for entering the proportional value used to tune the P.I.D. controller selected, by using pushbutton 2350, and displays the entered value. Pushbutton 2353 is operable for entering the Integral Value used to tune the P.I.D. controller selected, by operation of pushbutton 2350, and shows the entered value. Pushbutton 2354 is operable for entering the derivative value used to tune the P.I.D. controller selected, through use of pushbutton 2350 and shows the entered value. Pushbutton 2355 is operable for entering the loop update value used to tune the P.I.D. controller selected, by operation of pushbutton 2350, and shows the entered value.

Figure 24:
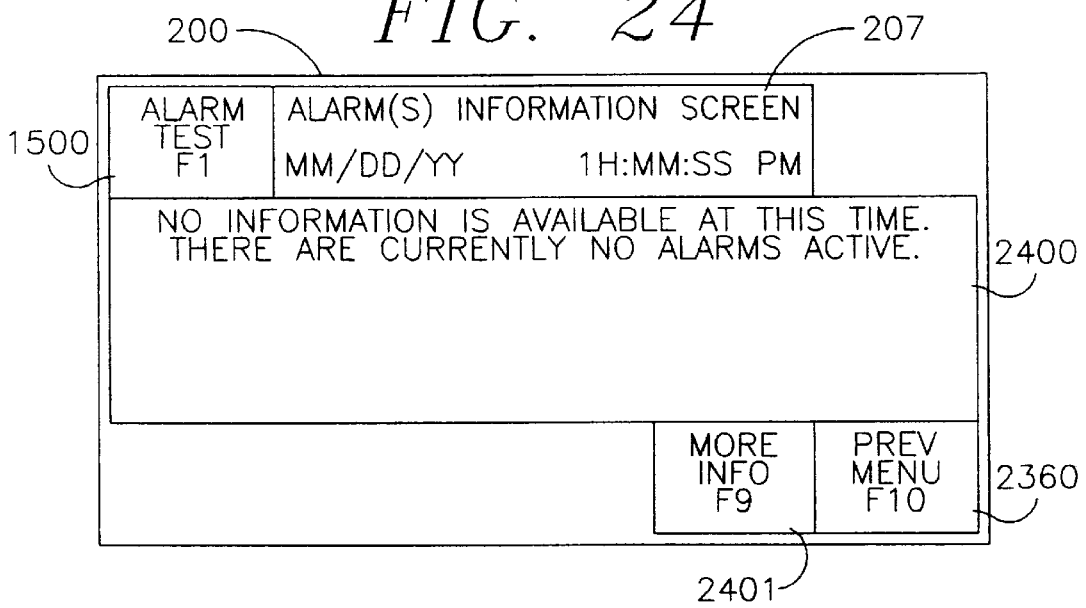
FIG. 24 shows an MMI display screen for an "ALARM (S) INFORMATION SCREEN"

With reference to FIG. 24, an "ALARM(S) INFORMATION SCREEN" is shown in display section 207. Pushbutton 2401 is operable as required, for advancing the information in display screen 2400 for calling up additional information, such as possible causes and remedies for any triggered alarm messages displayed in display area 207. Display screen section 2400 shows additional information selected through use of pushbutton 2401, for any triggered alarm messages displayed in display area 207.

Figure 26:
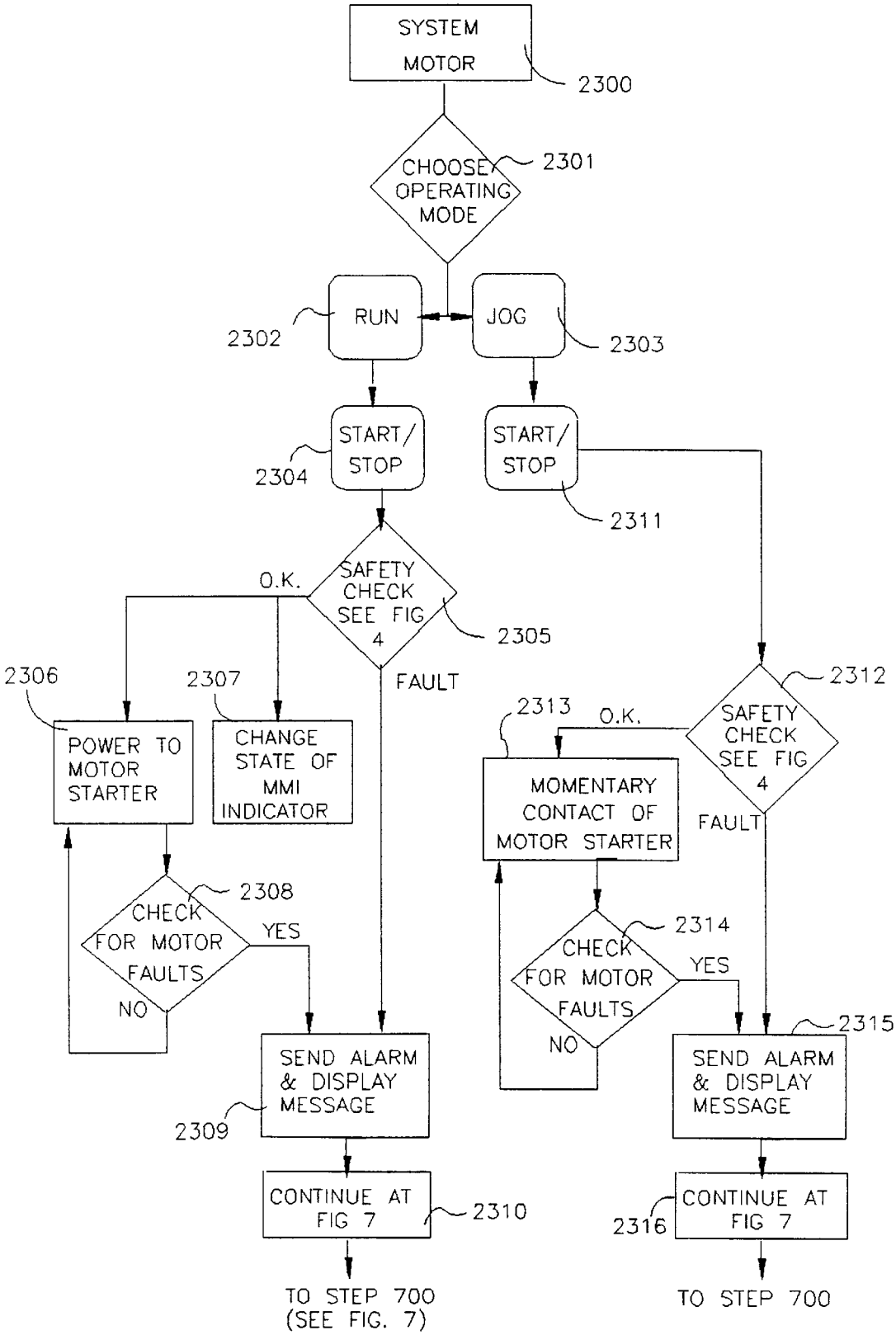
FIG. 26 shows a flowchart of steps for operating the present systems in a "Manual Mode of Operation".

With reference to FIG. 26, a flowchart is shown for the manual operation of all motors that are capable of manual control by an operator through use of the MMI menu shown in FIG. 20 and in FIGS. 16 through 21. In FIG. 26 a flowchart is shown for a programming of PLC 95 for operation of each one of the motors or motor drive systems previously mentioned above for various of the apparatus of the present system. This flowchart is a generalized flowchart, and the programming of PLC 95 includes an identical flowchart for each one of the motors in the systems, as previously mentioned, but programmed for a given motor, respectively. More specifically, with reference to this generalized flowchart, step 2300 establishes the programming for a particular one of the motors. In step 2301 an operating mode is selected by the operator by pushing either a "RUN" pushbutton represented by the run step 2302, or a pushbutton switch 2303 entitled "JOG" is depressed. Note that as previously described for the MMI menus, the actual display 200 will show a pushbutton "IN JOG" in a default mode, i.e. the related device is in JOG mode, and when this pushbutton is depressed the related device is placed into a "RUN" mode and the labeling of the pushbutton will change to indicate "IN RUN". Once the mode is established, an operator can depress a pushbutton switch represented by step 2304 as "START/STOP" for priming a motor in a Run Mode, or depressing the same pushbutton switch represented by 2304 to stop a particular motor from running. The labeling for the pushbutton will be either "START" or "STOP" depending upon the function that will be obtained upon depressing the pushbutton switch. Once a particular motor is primed for operating, before power is applied to the motor, a safety check is made as shown in step 2305 as shown in the flowchart of FIG. 4, the safety check being carried out as previously described. If the safety measures indicated in the flowchart of FIG. 4 are confirmed to be in placed, step 2306 is entered for applying power to the drive system for the particular motor, and in step 2307 the MMI touch screen display is changed to indicate that the particular motor is running. Upon applying power to the particular motor, step 2308 is entered for fault checking the particular motor. If no faults are found, power or a motor voltage continues to be applied to the motor drive system. Also, if a motor fault is detected, step 2309 is entered for activating an alarm, and displaying a message on the MMI display for indicating that a motor fault exists, and control is transferred to step 700 of the flowchart of FIG. 7 via step 2310. Note further that if in the safety check step 2305 a fault is detected, step 2309 is entered with the same result as previously described for 2309. If the operator elected to enter into a JOG mode for the motor by depressing a pushbutton switch designated as step 2303 in this flowchart, the operator would then proceed to step 2311 for pushing a pushbutton switch "START/STOP" to operate the particular motor as long as the associated switch is depressed. Upon depression of this switch, step 2312 is entered for conducting the safety check of the flowchart shown in FIG. 4, as previously described. If no faults are uncovered, step 2313 is entered for applying power to the motor drive system of the particular motor, immediately followed by step 2314 for conducting a motor fault test for the particular motor. If no faults are uncovered, as long as the start pushbutton switch associated with step 2311 is depressed, power continues to be applied to the motor, but if a fault is uncovered, the application of power is terminated and step 2315 is entered. Next, via step 2316 control is transferred to step 700 for the alarm flowchart of FIG. 7.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A grinding and/or pulverizing system for preventing the combustion of material being ground or pulverized, comprising:

means for grinding/pulverizing said material;

a housing including a chamber surrounding and enclosing said grinding/pulverizing means;

means for monitoring the level of oxygen in said chamber closed loop air circulation means independently connected to an air inlet port and an air outlet port of said chamber, for continuously circulating air through said chamber during operation of said grinding/pulverizing means;

means for delivering material to said grinding/pulverizing means; and injection means for periodically injecting an inert cryogenic fluid into said chamber to maintain the level of oxygen in said chamber below that supportive of combustion of said material, thereby minimizing the level of contaminants in the resulting ground product to an extent that said ground product is fit for human consumption.

2. The system of claim 1, wherein said closed loop air circulation means further includes:

an outlet duct connected at one end to said outlet port of said chamber for receiving ground or pulverized material from said grinding/pulverizing means for transport via return air flowing in said outlet duct;

a return duct;

dust collection means including an inlet port connected to another end of said outlet duct for receiving air and ground or pulverized product, filter means for filtering said return air and delivering the filtered air into one end of said return duct, and a product port from which ground or pulverized material can be collected for removal therefrom, another end of said return duct being coupled to said inlet port of said chamber; and a rotary air lock having an inlet port connected to said product port of said dust collection means for receiving said ground material, and a product delivery port for transferring product from said rotary air lock into areas within the ambient air without disrupting said closed loop air circulation means.

3. The system of claim 2, further including:

classifier means having a product inlet port connected to said product delivery port of said rotary air lock for receiving product therefrom, for separating the product both into finished product for delivery from a finished product port into a shipping container, and into oversized product for delivery from a product return port to said material delivery means via a duct connected therebetween, to provide reprocessing of the oversized product material.

4. The system of claim 1, wherein said inert cryogenic fluid of said injection means is liquid nitrogen.

5. The system of claim 1, further including:

means for measuring the temperature of air passing through said chamber, and providing at least a first temperature signal indicative thereof;

a controller responsive to said first temperature signal for operating said injection means to inject sufficient inert cryogenic fluid into said chamber for maintaining a desired temperature therein.

6. The system of claim 1, further including:

mean for measuring the level of oxygen in the air entering said chamber, for providing an oxygen level signal indicative thereof; and a controller responsive to said oxygen level signal for operating said injection means to inject sufficient inert cryogenic fluid into said chamber for maintaining a desired level of oxygen therein.

7. The system of claim 1, further including a controller programmed for automatically operating said system.

8. The system of claim 3, further including a controller programmed for automatically operating said system.

9. The system of claim 2, wherein said closed loop air circulation means further includes:

an air feed duct having one end connected to said inlet port of said chamber, and another end;

a fan having an air inlet port connected to another end of said return duct, and an outlet port connected to said another end of said air feed duct.

10. The system of claim 5, further including:

an alarm; and said controller being programmed to activate said alarm in the event of a monitored portion of said system going into a fault mode.

11. A method for grinding and/or pulverizing system for preventing the combustion of material being processed, comprising the steps of:

installing a grinder/pulverizer means within a chamber of a housing;

forming a closed loop airflow system sealed off from the ambient air for continuously circulating air through said chamber during operation of said grinder/pulverizer apparatus;

selectively monitoring the level of oxygen of the air being circulated through said chamber;

delivering material to said grinding/pulverizing means and grinding/pulverizing said material; and injecting an inert cryogenic fluid into said chamber for maintaining the monitored level of oxygen in said chamber below that supportive of combustion of said material thereby minimizing the presence of contaminants in the resulting ground product to an extent that said ground product is fit for human consumption.

12. The method of claim 11, wherein said inert cryogenic fluid is liquid nitrogen.

13. The method of claim 11, further including the steps of:

transporting the said material processed by said grinder/pulverizer apparatus from said chamber via circulating air exiting therefrom to a filter apparatus in said closed loop airflow system;

permitting processed material to collect at a bottom of a filter housing of said filter apparatus;

providing a rotary air lock at a material exit port in the bottom of said filter housing;

operating said rotary air lock for removing processed material therefrom without exposing said closed loop airflow system to the ambient air;

filtering air passing through said filter apparatus; and returning said filtered air via said closed loop airflow system to said grinder/pulverizer apparatus.

14. The method of claim 13, further including the steps of:

operating said rotary air lock to remove processed material from said material exit port of said filter housing, for delivery to classifier apparatus;

operating said classifier apparatus for separating oversized particles of said processed material from particles of said processed material relatively small enough to provide a desired finished product;

returning the oversized particles to said grinder/pulverizer apparatus for further processing; and delivering the finished product to shipping containers.

15. The method of claim 14, further including the steps of:

stirring said processed material at the bottom of said filter housing while operating said rotary air lock.

16. The method of claim 13, further including the step of:

locating a fan between a filter within said filter housing and said chamber of said grinder/pulverizer apparatus in the closed loop airflow system, for providing the motive power to circulate air therethrough and from said filter to said chamber.

17. The method of claim 16, further including in said monitoring step, the step of locating an oxygen analyzer in an airflow path in said closed loop airflow system between said fan and said chamber, for monitoring the level of oxygen of air being delivered into said chamber.

18. The method of claim 11, further including in said monitoring step the step of locating a thermocouple in an airflow path of air exiting said chamber of said grinder/pulverizer in said closed loop airflow, for providing a temperature signal indicative of the temperature of air in said chamber.

19. The method of claim 15, further including the step of:

programming a controller for automatically operating said grinding and/or pulverizer system.

* * * * *